United States Patent [19]

Nishio et al.

[11] Patent Number: 5,068,691

[45] Date of Patent: Nov. 26, 1991

[54] DEVELOPING DEVICE WITH A CONTROLLABLE PRESSURE RELEASE FOR THE DEVELOPING ROLLER

[75] Inventors: Yukio Nishio, Tama; Kazunori Hirose, Hiratsuka, both of Japan

[73] Assignee: Fujitsu Limited, Kawasaki, Japan

[21] Appl. No.: 530,518

[22] Filed: May 30, 1990

[30] Foreign Application Priority Data

| | | | |
|---|---|---|---|
| Jun. 1, 1989 | [JP] | Japan | 1-139445 |
| Jun. 5, 1989 | [JP] | Japan | 1-141217 |
| Jun. 21, 1989 | [JP] | Japan | 1-159320 |
| Jun. 26, 1989 | [JP] | Japan | 1-163120 |

[51] Int. Cl.[5] ..... G03G 15/08

[52] U.S. Cl. ..... 355/259; 118/261; 118/653

[58] Field of Search ..... 355/259, 245; 118/644, 118/653, 261

[56] References Cited

U.S. PATENT DOCUMENTS

| | | | |
|---|---|---|---|
| 4,339,196 | 7/1982 | Beck et al. | 355/245 X |
| 4,754,301 | 6/1988 | Kasamura et al. | 355/245 |
| 4,801,966 | 1/1989 | Ikeda | 355/245 |
| 4,851,873 | 7/1989 | Sakao et al. | 355/245 |
| 4,860,053 | 8/1989 | Yamamoto et al. | 355/245 |
| 4,896,193 | 1/1990 | Kagiura et al. | 355/245 X |
| 4,899,689 | 2/1990 | Takeda et al. | 355/259 X |
| 4,928,146 | 5/1990 | Yamada | 355/245 X |
| 4,930,438 | 6/1990 | Demizu et al. | 355/259 X |
| 4,939,547 | 7/1990 | Miyaji et al. | 355/245 |
| 4,958,191 | 9/1990 | Yamada et al. | 355/245 |

FOREIGN PATENT DOCUMENTS

| | | | |
|---|---|---|---|
| 60-6846 | 3/1985 | Japan . | |
| 60-12627 | 4/1985 | Japan . | |
| 61-43767 | 3/1986 | Japan . | |
| 62-976 | 1/1987 | Japan . | |
| 62-96981 | 5/1987 | Japan . | |
| 62-118372 | 5/1987 | Japan . | |
| 62-269977 | 11/1987 | Japan | 355/259 |
| 63-100476 | 5/1988 | Japan | 355/259 |
| 63-100482 | 5/1988 | Japan . | |
| 63-189876 | 8/1988 | Japan . | |
| 63-231469 | 9/1988 | Japan . | |
| 1-108582 | 4/1989 | Japan | 355/259 |

*Primary Examiner*—R. L. Moses

*Attorney, Agent, or Firm*—Armstrong, Nikaido, Marmelstein, Kubovcik & Murray

[57] ABSTRACT

The present invention is directed to a developing device using a one-component developer composed of colored fine sythetic resin toner particles. The device includes a vessel for holding the developer and a developing roller rotatably provided within the vessel, a portion thereof being exposed therefrom and resiliently pressed against a surface of an photosensitive drum. The toner particles are held by the surface of the developing roller to form a developer layer therearound, and are carried to the surface of the image formation drum for development of an electrostatic latent image formed thereon. The developing device further incorporates a blade member provided within the vessel and resiliently engaged with the developing roller for regulating a thickness of the developer layer formed therearound. The pressures exerted on the developing roller by the phososensitive drum and the blade member, respectively, can be at least partially released.

29 Claims, 22 Drawing Sheets

DEVELOPING DEVICE WITH A CONTROLLABLE PRESSURE RELEASE FOR THE DEVELOPING ROLLER

BACKGROUND OF THE INVENTION

1) Field of the Invention

The present invention relates to a developing device used in an electrophotographic field, wherein an electrostatic latent image is visually developed by using a one-component developer, particularly a non-magnetic type one-component developer.

2) Description of the Related Art

As is well known, an electrophotographic printer carries out the processes of: producing a uniform distribution of electrical charges on a surface of an electrostatic latent image carrying body such as an electrophotographic photoreceptor; forming an electrostatic latent image on the electrically charged surface of the electrophotographic photoreceptor by optically writing an image thereon, using a laser beam scanner, an LED (light emitting diode) array, an LCS (liquid crystal shutter) array or the like; visually developing the electrostatic latent image with a developer, i.e., toner, which is electrically charged to be electrostatically adhered to the electostatic latent image zone; electrostatically transferring the developed visible image to a paper; and fixing the transferred image on the paper. Typically, the electrophotographic photoreceptor is formed as a photosensitive drum having a cylindrical conductive substrate and a photoconductive insulating film bonded to a cylindrical surface thereof.

In the developing process, a two-component developer composed of a toner component (colored fine synthetic resin particles) and a magnetic component (magnetic fine carriers) is widely used, as it enables a stable development of the latent image. Note, typically the toner particles have an average diameter of about 10 μm, and the magnetic fine carriers have a diameter ten times larger than the average diameter of the toner particles. Usually, a developing device using the two-component developer includes a vessel for holding the two-component developer, wherein the developer is agitated by an agitator provided therein. This agitation causes the toner particles and the magnetic carriers to be subjected to triboelectrification, whereby the toner particles are electrostatically adhered to each of the magnetic carriers. The developing device also includes a magnetic roller, provided in the vessel as a developing roller, in such a manner that a portion of the magnetic roller is exposed therefrom and faces the surface of the photosensitive drum. The magnetic carriers with the toner particles are magnetically adhered to the surface of the magnetic roller to form a magnetic brush therearound, and by rotating the magnetic roller carrying the magnetic brush, the toner particles are brought to the surface of the photosensitive drum for the development of the electrostatic latent image formed theron.

In this developing device, a ratio between the toner and magnetic components of the developer body held in the vessel must fall within a predetermined range, to continuously maintain a stable development process. Accordingly, the developing device is provided with a toner supplier from which a toner component is supplied to the two-component developer held in the vessel, to supplement the toner component as it is consumed during the development process, whereby the component ratio of the two-component developer held by the vessel is kept within the predetermined range. This use of a two-component developer is advantageous in that a stable development process is obtained thereby, but the developing device per se has the disadvantages of a cumbersome control of a suitable component ratio of the two-component developer, and an inability to reduce the size of the developing device due to the need to incorporate the toner supplier therein.

A one-component developer is also known in this field, and a developing device using same does not suffer from the above-mentioned disadvantages of the developing device using the two-component developer, because the one-component developer is composed of only a toner component (colored fine synthetic resin particles). Two types of the one-component developer are known; a magnetic type and a non-magnetic type. A developing device using the magnetic type one-component developer can be constructed in substantially the same manner as that using the two-component developer. Namely, the magnetic type one-component developer also can be brought to the surface of the photosensitive drum by a rotating magnetic roller as in the developing device using the two-component developer. The magnetic type one-component developer is suitable for achromatic color (black) printing, but is not suitable for chromatic color printing. This is because each of the toner particles composing the magnetic type one-component developer includes fine magnetic powders having a dark color. In particular, the chromatic color printing obtained from the magnetic type one-component developer appears dark and dull, due to the fine magnetic powders included therein. Conversely, the non-magnetic type one-component developer is particularly suitable for chromatic color printing because it does not include a substance having a dark color, but the non-magnetic type one-component developer cannot be brought to the surface of the photosensitive drum by the magnetic roller as mentioned above.

A developing device using the non-magnetic type one-component developer is also known, as disclosed in U.S. Pat. No. 3,152,012 and No. 3,754,963, Japanese Examined Patent Publication (Kokoku) No. 60-12677, and Japanese Unexamined Patent Publications (Kokai) No. 62-976, No. 62-118372, No. 63-100482, and No. 63-189876. These developing devices include a vessel for holding the non-magnetic type one-component developer, and a conductive elastic roller provided within the vessel as a developing roller in such a manner that a portion of the elastic roller is exposed therefrom and can be pressed against the surface of the photosensitive drum. The conductive elastic developing roller may be formed of a conductive silicone rubber material or a conductive polyurethane rubber material or the like. When the conductive rubber roller is rotated within the body of the non-magnetic type one-component developer held by the vessel, the toner particles composing the non-magnetic type one-component developer are frictionally entrained by the surface of the conductive rubber developing roller to form a developer layer therearound, whereby the toner particles can be brought to the surface of the photosensitive drum for the development of the electrostatic latent image formed thereon. The developing device further includes a blade member which is resiliently pressed against the surface of the developing roller, to uniformly regulate a thickness of the developer layer formed therearound so that an even development of the latent image can be carried out. The blade member also serves to electrically charge the toner particles by a triboelectrification therebetween.

In this developing device, the development process is carried out in such a manner that, at the area of contact between the photosensitive drum and the conductive rubber developing roller carrying the developer layer, the charged toner particles are electrostatically attracted and adhered to the latent image due to a bias voltage applied to the conductive solid rubber developing roller.

To achieve a proper development of the latent image by the developing rubber roller, an elasticity or hardness of the developing roller is an important parameter, because the development quality and the development toner density are greatly affected by a contact or nip width between the photosensitive drum and the solid rubber developing roller pressed thereagainst. Namely, the developing roller must be pressed against the photosensitive drum so that a given nip width by which a proper development is obtained is established therebetween. When the developing roller is formed as a solid rubber roller, it may have a relatively high hardness. For example, when measured by an Asker C-type hardness meter, the solid rubber developing roller showed an Asker C-hardness of about 58°. Accordingly, the solid rubber developing roller must be pressed against the photosensitive drum with a relatively high pressure to obtain the required nip width therebetween, but the higher the pressure exerted upon the photosensitive drum by the developing roller, the greater the premature wear of the drum.

It has been suggested by the inventors that the developing roller be formed of a conductive open-cell elastic material, to give it a high softness. Such a conductive open-cell elastic developing roller is constituted to prevent a penetration of the toner particles into an open-cell foam structure thereof, whereby the high softness of the developing roller can be maintained over a long period.

Conventionally, even though the developing device is in a non-operative condition, the developing roller is left as it is. Namely, even during the non-operative condition of the developing device, the developing roller is not released from the pressures exerted thereon by the photosensitive drum and the blade member. Accordingly, if the electrophotographic printer is not operated for a long time and/or if deterioration of the developing roller occurs, the developing roller is subjected to a plastic deformation.

In particular, the conductive open-cell elastic developing roller is suspectible to such a plastic deformation due to the high softness thereof. As is obvious, when the developing roller is deformed, a proper development of the latent image cannot be carried out. Also, when the pressures exerted on the developing roller are not released, the toner particles between the developing roller and the photosensitive drum and blade member may be adhered to each other, due to these pressures, and thus a poor development of the latent image may occur.

Conventionally, when the developing device is movable away from and toward the photosensitive drum, to resiliently press the developing roller against the photosensitive drum, a drive motor for the developing roller is supported by a frame structure of the electrophotographic printer, and a gear train for transmitting a rotational drive force from the drive motor to the developing roller is provided on one of the side wall portions of the developing device. The gear train is not engaged with an output gear of the drive motor until the developing device is positioned at a developing position in which the developing roller is resiliently pressed against the photosensitive drum. Nevertheless, even though the developing device is positioned at the developing position, it is still slightly movable toward and away from the photosensitive drum, and accordingly the developing device may subjected to a twist motion due to the drive force of the motor, and thus it is difficult to resiliently press the developing roller against the photosensitive drum with a uniform linear pressure, resulting in an uneven development of the latent image.

Also known is a developing device provided with a detector for detecting a lack of the developer held in the vessel and raising an alarm to inform the operator that the consumption of the developer has reached a predetermined level, as disclosed in Japanese Examined Patent Publication No. 62-502, but the conventional detector is very complex and costly.

Furthermore, a developing device provided with a seal arrangement for preventing a leakage of the developer at locations near to the ends of the developer roller is known. This leakage of the developer is apt to occur at locations near to the ends of the developer roller because, when a thickness of the developer layer is regulated by the blade member, the excess developer has a tendency to be pushed toward the ends of the developer roller. The conventional seal arrangement does not provide an effective and complete prevention of the developer leakage at the ends of the developing roller.

SUMMARY OF THE INVENTION

Therefore, an object of the present invention is to provide a developing device as mentioned above, wherein the pressures exerted on the developing roller by the photosensitive drum and the blade member can be at least partially released during the non-operative condition of the developing device, whereby a plastic deformation of the developing roller can be avoided.

Another object of the present invention is to provide a developing device as mentioned above, which is movable away from and toward the photosensitive drum, to resiliently press the developing roller against the photosensitive drum, wherein a transmission of a rotational drive force from the drive motor to the developing roller can be stably carried out, whereby an even development of the latent image can be ensured.

Yet another object of the present invention is to provide a developing device as mentioned above, having a detector for detecting a lack of the developer, which can be simply and economically constructed.

Yet another object of the present invention id to provide a developing device as mentioned above, having a seal arrangement by which a prevention of the developer leakage at the ends of the developing roller can be effectively and completely carried out.

According to the present invention, there is provided a developing device using a one-component developer composed of toner particles, which device comprises: a vessel for holding the developer, the vessel being movable between first and second positions; a developing roller rotatably provided within and supported by the vessel in such a manner that a portion of the developing roller is exposed therefrom, the exposed portion of the developing roller being pressed against a surface of an electrostatic latent image carrying body when positioning the vessel at the first position thereof, the developing roller being formed of a conductive elastic material by which the toner particles are entrained to form a developer layer therearound and are carried to the surface of the electrostatic latent image carrying body for development of an electrostatic latent image formed thereon; a blade member provided within and movably supported by the vessel, the blade member being movable between first and second positions, the blade member being pressed against the developing roller for regulating a thickness of the developer layer formed therearound when positioning the blade member at the first position thereof; and means for moving the vessel and the blade member from the first positions thereof to the second positions thereof so that the pressures exerted on the developing roller by the electrostatic latent image carrying body and the blade member, respectively, can be at least partially released. In the present invention, by moving the electrostatic latent image carrying body away from the developing roller, the pressure exerted on the developing roller by the electrostatic latent image carrying body may be released.

According to another aspect of the present invention, there is provided a developing device using a one-component developer composed of toner particles, which device comprises: a movable vessel for holding the developer; a developing roller rotatably provided within and supported by the movable vessel in such a manner that a portion of the developing roller is exposed therefrom, the exposed portion of the developing roller being pressed against a surface of an electrostatic latent image carrying body by biasing the movable vessel toward the electrostatic latent image carrying body, the developing roller being formed of a conductive elastic material by which the toner particles are entrained to form a developer layer therearound and are carried to the surface of the electrostatic latent image carrying body for development of an electrostatic latent image formed thereon; and a drive source for rotating the developing roller, the drive source being attached to the movable vessel. In the present invention, when the vessel is mounted in a movable frame, the drive source may be attached to the movable frame.

According to yet another aspect of the present invention, there is provided a developing device using a one-component developer composed of toner particles, which device comprises: a vessel for holding the developer; means for carrying the developer from the vessel to an electrostatic latent image carrying body for development of an electrostatic latent image formed thereon; an agitator having an agitating element rotated within the vessel for agitating the developer; and means for detecting a lack of the developer held in the vessel, the lack of developer detecting means including a first element entrained and rotated by the agitating element, a second element rotated together with the first element, a third element rotated together with the agitating element, and a detector for detecting a passage of the second element at a given position, wherein when the first element is entrained and rotated by the agitating element, the second and third elements are aligned with each other so that a detection of the passage of the second element by the detector is prevented by the third element, and wherein, when an amount of the developer is less than a predetermined level, the first element is rotated faster, due to the force of gravity, than the agitating element so that a detection of the passage of the second element by the detector becomes possible.

According to yet another aspect of the present invention, there is provided a developing device using a one-component developer composed of toner particles, which device comprises: a vessel for holding the developer; a developing roller rotatably provided within and supported by the vessel in such a manner that a portion of the developing roller is exposed therefrom, the exposed portion of the developing roller facing a surface of an electrostatic latent image carrying body, the developing roller being formed of a conductive elastic material by which the toner particles are entrained to form a developer layer therearound and are carried to the surface of the electrostatic latent image carrying body for development of an electrostatic latent image formed thereon; and a blade member provided within and movably supported by the vessel, the blade member being movable between first and second positions, the blade member being pressed against the developing roller for regulating a thickness of the developer layer formed therearound, wherein axial lengths of the developing roller and the blade member are longer than a width of a developer stream directed to the developing roller in the vessel, and wherein seal members are applied to end zones of the developing roller and end zones of the blade member.

BRIEF DESCRIPTION OF THE INVENTION

The other objects and advantages of the present invention will be better understood from the following description, with reference to the accompanying drawings, in which.

DESCRIPTION OF THE PREFERRED EMBODIMENTS

Figure 1:
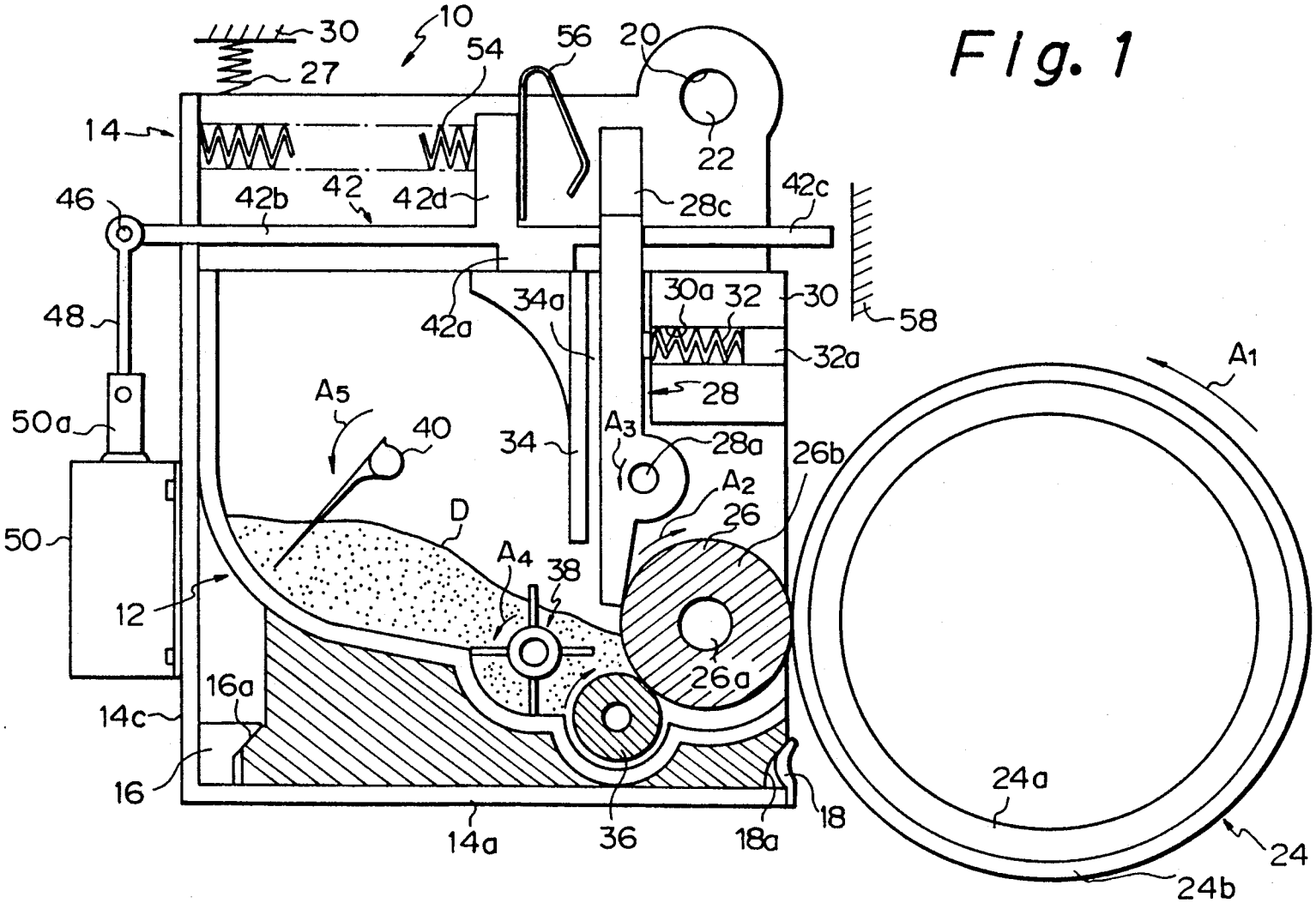
FIG. 1 is a schematic view showing an embodiment of a developing device according to the present invention.
Figure 2:
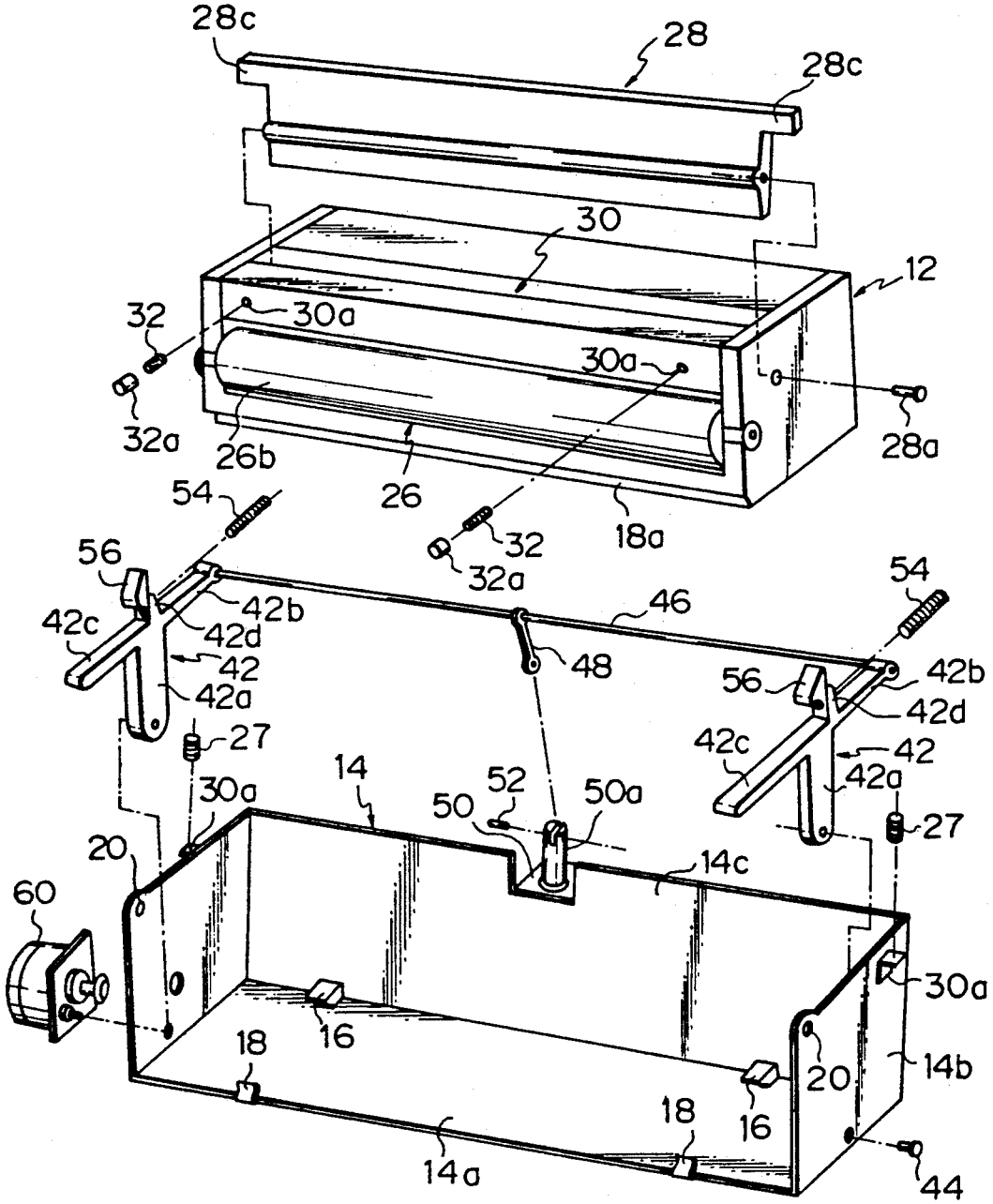
FIG. 2 is an exploded view of the developing device of FIG. 2.

FIG. 1 schematically shows a developing device 10 using a non-magnetic type one-component developer incorporated into an electrophotographic printer (not shown). The developing device 10 comprises a vessel 12 for holding a non-magentic type one-component developer D composed of colored fine toner particles of a suitable synthetic resin such as polyester or styrene acrylic resin, and having an average diameter of about 10 μm. As shown in FIG. 2, the vessel 12 has a generally rectangular parallelopiped shape, and is received in and supported by a frame casing 14 in the form of a shelf-like structure having a rectangular bottom plate 14*a*, side walls 14*b* extended upward from the shorter sides thereof, and a back wall 14*c* extended upward from one of the longer sides of the bottom plate 14*a*; the vessel 12 has a box-like configuration matching that of the frame casing 14.

As best shown in FIG. 2, the rectangular bottom plate 14*a* of the frame casing 14 is provided with a pair of projections 16, 16 and a pair of resilient tongue elements 18, which are disposed along the long side edges of the bottom plate 14*a*, respectively. When the vessel 12 is received in the frame casing 14, the projections 16, 16 are engaged with the face of an acute shoulder 16*a* forming a part of a back wall surface of the vessel 12, near the bottom thereof, and the resilient tongue elements 18 are firmly engaged with a semi-circular groove 18*a* formed in a front bottom edge of the vessel 12, as shown in FIG. 1, whereby the vessel 12 is securely and fixedly supported on the bottom plate 14*a* of the frame casing 14. Each of the side walls 14*b* of the frame casing 14 is provided with a hole 20 formed at an upper front corner thereof, and the frame casing 14 is swingably suspended from a shaft 22 extended through the holes 20 of the side walls 14*b* and supported by a frame structure of the electrophotographic printer (not shown), whereby the frame casing 14, and therefore the vessel 12, can be moved toward and away from a photosensitive drum 24 forming a part of the electrophotographic printer.

The photosensitive drum 24 comprises a sleeve substrate 24*a* made of a conductive material such as aluminum, and a photoconductive material film 24*b* formed therearound. The photoconductive material film 24*b* of the photosensitive drum 24 may be composed of an organic photoconductor (OPC), a selenium photoconductor or the like. A uniform distribution of electrical charges is produced on a surface of the photoconductive material film 24*b* of the photosensitive drum 24 by a suitable discharger (not shown), such as a corona discharger, and an electrostatic latent image is then optically written on the charged surface of the photoconductive material film 24*b* by an optical writing means (not shown) such as a laser beam scanner, an LED (light emitting diode) array, an LCS (liquid crystal shutter) array or the like. In particular, when the charged area of the photoconductive material film 24*b* is illuminated by the optical writing means, the charges are released from the illuminated zone through the grounded sleeve substrate 24*a*, so that a potential difference between the illuminated zone and the remaining zone forms the electrostatic latent image.

Figure 3:
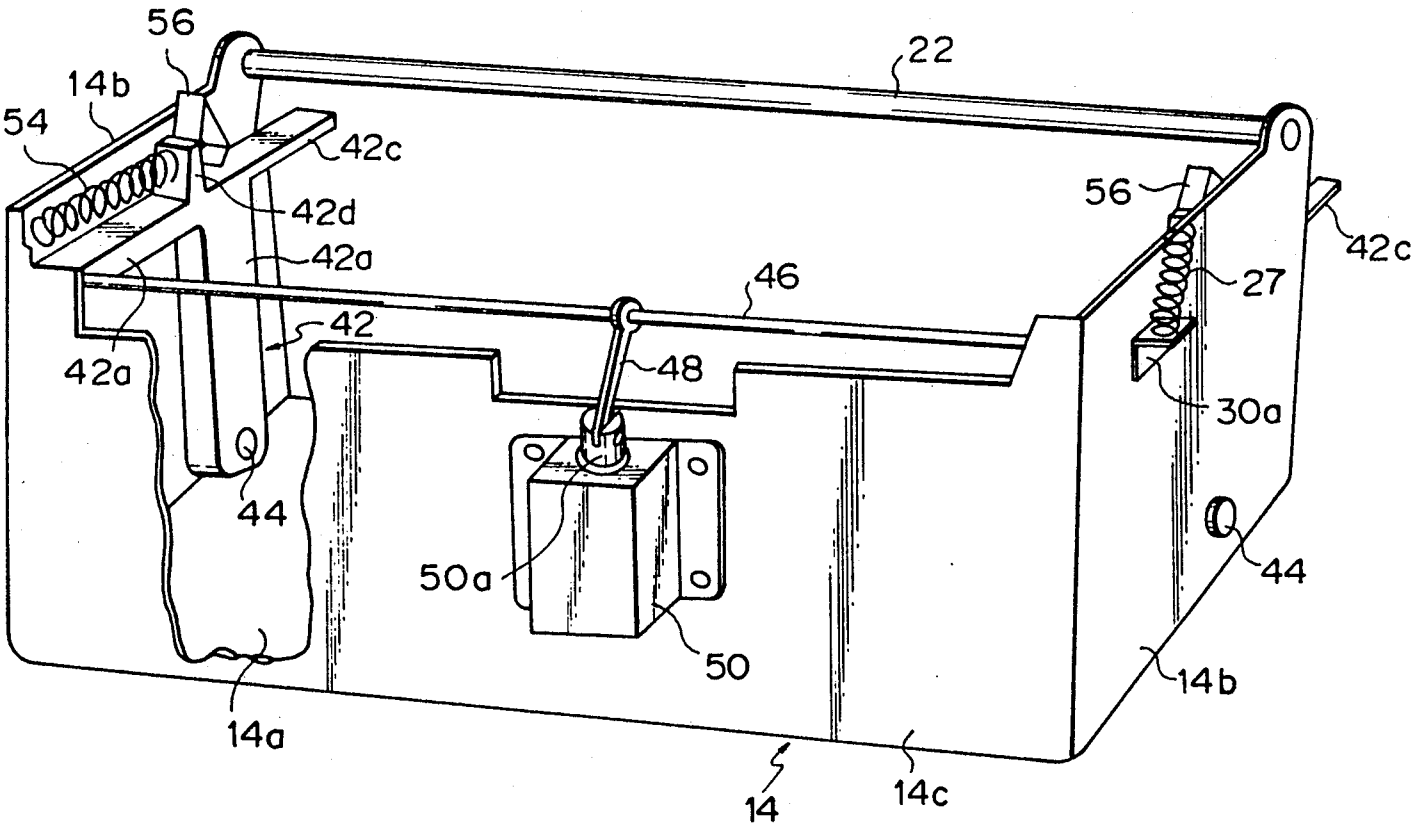
FIG. 3 is a perspective view of a frame casing of the developing device of FIG. 1.

The developing device 10 also comprises a developing rubber roller 26 rotatably supported between the side walls of the vessel 12, and having a portion thereof exposed at a front of the vessel 12. The frame casing 14 is resiliently biased toward the photosensitive drum 24 by a pair of coil springs 27 fitted between the printer frame structure and the frame casing 14, and thus the exposed portion of the developing roller 26 is resiliently pressed against the surface of the photosensitive drum 24. Note, in FIG. 1, a portion of the printer frame structure on which the coil springs 27 act is symbolically represented by reference numeral 30, and the coil springs 27 also act on L-shaped shelf elements 30*a* fixed on the outer wall surfaces of the side walls 14*b*, respectively, as shown in FIGS. 2 and 3.

During the operation of the developing device 10, the photosensitive drum 24 and the developing roller 26 are rotated in the directions indicated by arrows $A_1$ and $A_2$, respectively, whereby the developing roller 26 entrains the toner particles to form a developer layer therearound, and thus the toner particles are brought to the surface of the photosensitive drum 24 for the development of the latent image formed thereon. For example, the photosensitive drum 24 may have a diameter of 60 mm and a peripheral speed of 70 mm/s, and the developing roller 26 may have a diameter of 20 mm and a peripheral speed of from 1 to 4 times that of the photosensitive drum 24.

The developing roller 26 comprises a shaft 26*a* rotatably supported by the side walls of the vessel 12, and a roller element 26*b* mounted thereon. The roller element 26*b* is preferably formed of a conductive open-cell foam rubber material based upon polyurethane, silicone, acrylonitrile-butadiene or the like. In this case, the roller element 26b is preferably constituted in such a manner that pore openings appear in an outer surface of the roller element 26b, and the diameter of these pore openings is at most twice the average diameter of the toner particles, so that a penetration of the toner particles to the inside of the open-cell foam structure of the roller element 26b can be effectively prevented, and thus the high softness of the roller element 26b can be maintained over a long period. The roller element 26b formed of the conductive open-cell foam rubber material preferably has an Asker-C hardness of from about 10° to 50°, more preferably 10°, and thus it is possible to press the developing roller 26 against the photosensitive drum 24 at a linear pressure of from about 22 to 50 g/cm, most preferably 43 g/cm, so that a contact or nip width of from about 1 to 3.5 mm can be obtained between the developing roller 26 and the photosensitive drum 24. The contact or nip width of from about 1 to 3.5 mm is necessary to a proper development of the latent image. Also, the roller element 26b preferably has a volume resistivity of from about $10^4$ to $10^{10}$ Ω·m, most preferably $10^6$ Ω·m. Note, the roller element 26b may serve to electrically charge the toner particles by a triboelectrification therebetween.

The developing device 10 further comprises a blade member 28 engaged with the surface of the developing roller 26, to uniformalize a thickness of the developer layer formed therearound, and thereby ensure an even development of the latent image. The blade member 28 is pivotably mounted between the side walls of the vessel 12 by pivot pins 28a, as shown in FIG. 2. Further, an elongated block member 30 is provided between the side walls of the vessel 12 near the blade member 28 and above the developing roller 26, and has through holes 30a formed therein, each of which receives a coil spring 32 and a stopper element 32a to resiliently bias the blade member 28 in a direction indicated by an arrow $A_3$. With this arrangement, the blade member 28 may be resiliently pressed against the developing roller 18 at a linear pressure of about 26 g/mm, to regulate the thickness of the developer layer formed therearound. The vessel 12 is provided with a partition 34 disposed therein adjacent to the blade member 28, as shown in FIG. 1, so that a space 34a free from the developer D remains therebetween. The blade member 28 may be formed of a suitable non-conductive or conductive rubber material, but preferably is coated with Teflon, and may be further formed of a suitable metal material such as aluminum, stainless steel, brass or the like. Note, the blade member 28 may also serve to electrically charge the toner particles by a triboelectrification therebetween.

The developing device 10 further comprises a toner-removing roller 36 rotatably provided within the vessel 12 and in contact with the developing roller 26 in such a manner that a contact or nip width of about 1 mm is obtained therebetween, and by which remaining toner particles not used for the development of the latent image are removed from the developing roller 26. The toner-removing roller 36 may be formed of a conductive open-cell foam rubber material, preferably a conductive open-cell foam polyurethane rubber material having a volume resistivity of about $10^6$ Ω·m, and an Asker-C hardness of from about 10° to 70°, most preferably 30°. The toner-removing roller 36 is rotated in the same direction as the developing roller 26, whereby the remaining toner particles are mechanically removed from the developing roller 26. For example, the toner-removing roller 36 may have a diameter of 11 mm and a peripheral speed of from 0.5 to 2 times that of the developing roller 26. In the embodiment shown in FIG. 1, the toner-removing roller 36 is partially received in a recess formed in a bottom of the vessel 12, whereby a leakage of the toner particles from a space between the developing roller 26 and the vessel bottom can be prevented.

Further, the developing device 10 comprises a paddle roller 38 for moving the toner particles toward the developing roller 26, and an agitator 40 for agitating the developer D to remove a dead stock from the vessel 12. The paddle roller 18 and the agitator 28 are rotated in the directions indicated by arrows $A_4$ and $A_5$, respectively.

In operation, for example, when the photosensitive film 24b of the photosensitive drum 24 is formed of an organic photoconductor (OPC), a distribution of a negative charge is produced thereon, a charged area of which may have a potential of from about −600 to −650 volts. In this case, the latent image zone formed on the drum 24 by the optical writing means may have a reduced potential of about −50 volts. Note, in this case, the toner particles are given a negative charge. When the developing roller 26 is rotated within the developer D, the toner particles are frictionally entrained by the surface of the roller element 26b, and thus the toner particles are carried to the surface of the photosensitive drum 24.

A developing bias voltage of from about −200 to −500 volts is applied to the developing roller 26, so that the toner particles carried to the surface of the drum 24 are electrostatically attracted only to the latent image zone having the potential of about −50 volts, as if the latent image zone were charged with the negative toner particles, and thus the toner development of the latent image is carried out.

As mentioned above, the remaining toner particles not used for the development are mechanically removed from the developing roller 26 by the toner-removing roller 36, but the remaining toner particles also can be electrostatically removed from the developing roller 26 by applying a bias voltage of from −150 to −400 volts to the toner-removing roller 36. Since the developer layer formed of the remaining toner particles is subjected to physical and electrical effects during the developing process, it should be removed from the developing roller 26 and a fresh developer layer be formed thereon.

On the other hand, when the blade member 28 is formed of the conductive material, a bias voltage of from about −200 to −500 volts is applied to the conductive blade member 28 so that the charged toner particles are not electrostatically adhered to the blade member 28. This is because, when the blade member has an opposite polarity with respect to a potential of the developing bias voltage applied to the developing roller 26, the toner particles are electrostatically adhered to the blade member 28, to thereby hinder an even formation of the developer layer around the developing roller 26. The application of the bias voltage to the blade member 28 may also contribute to the charging of the toner particles by a charge-injection effect.

Note, when the photoconductive material film 24b of the photosensitive drum 24 is composed, for example, of a selenium photoconductor, on which a distribution of a positive charge is produced, the toner particles are positively charged and a positive bias voltage is applied to the developing roller 26 and the blade member 36.

When the developing operation is stopped, i.e., when the rotation of the developing roller 26 is stopped, the pressures exerted thereon by the phososensitive drum 24 and the blade member 28, respectively, must be released, because otherwise the roller element 26*b* will be plastically deformed while the developing roller 26 is at a stop. To this end, the developing device 10 is provided with a pressure release mechanism, to prevent this plastic deformation of the developing roller 26.

In this embodiment, the pressure release mechanism includes a pair of generally T-shaped lever members 42, each of which has a stem 42*a*, and arms 42*b* and 42*c* perpendicularly extending from a top end thereof. The T-shaped lever members 42 are disposed between the side walls 14*b* and the side walls of the vessel 12, respectively, and each of the T-shaped lever members 42 is pivotally attached at a lower end of the stem 42*a* thereof to the corresponding side wall 14*b* by a pivot pin 44, as shown in FIGS. 2 and 3. The T-shaped lever members 42 are connected to each other by a connecting rod 46, the ends of which are coupled to free ends of the arms 42*b*, respectively. The pressure release mechanism also includes a link element 48 having one end pivotally connected to the connecting rod 46 at a middle point thereof, and a solenoid actuator 50 having a working rod 50*a* pivotally connected to the other end of the link 48 by a pivot pin 52. Each of the T-shaped lever members 42 has a protrusion 42*d* extended upward from a transition region between the stem 42*a* and the arm 42*b*. The pressure release mechanism further includes a coil spring 54 acting between a back of the protrusion 42*d* of each T-shaped lever member 42 and the back wall 14*c* of the frame casing 14, as shown in FIG. 1, and a generally U-shaped leaf spring 56 secured to the protrusion 42*d* of each T-shaped lever member 42 at a front thereof. The coil springs 54 serve to resiliently bias the T-shaped lever members 42 in the clockwise direction in FIG. 1, and the U-shaped leaf springs 56 face portions 28*c* extended from the blade member 28, respectively, as shown in FIG. 1.

Figure 4:
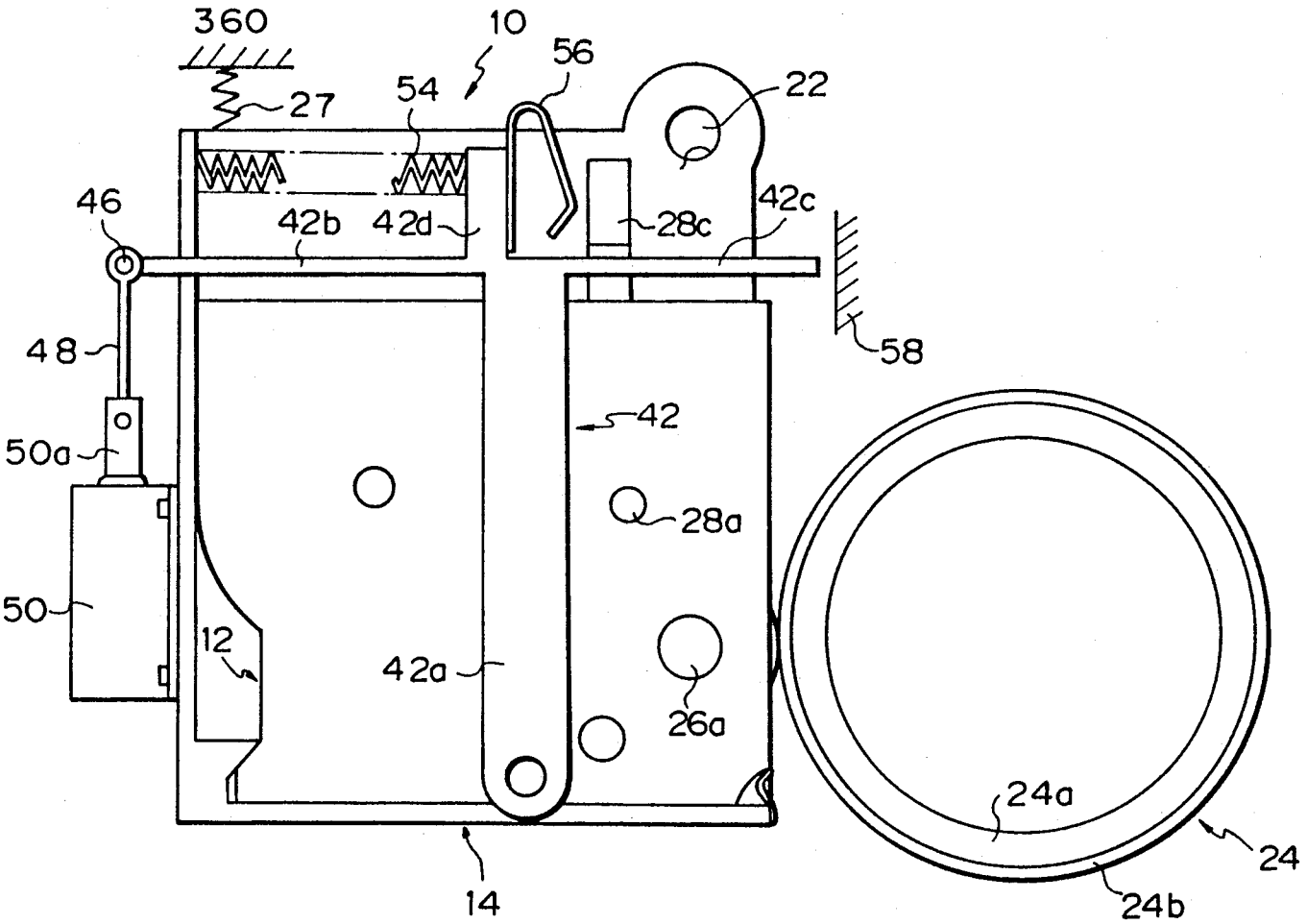
FIG. 4 is a view similar to FIG. 1, showing a solenoid actuator when energized.
Figure 5:
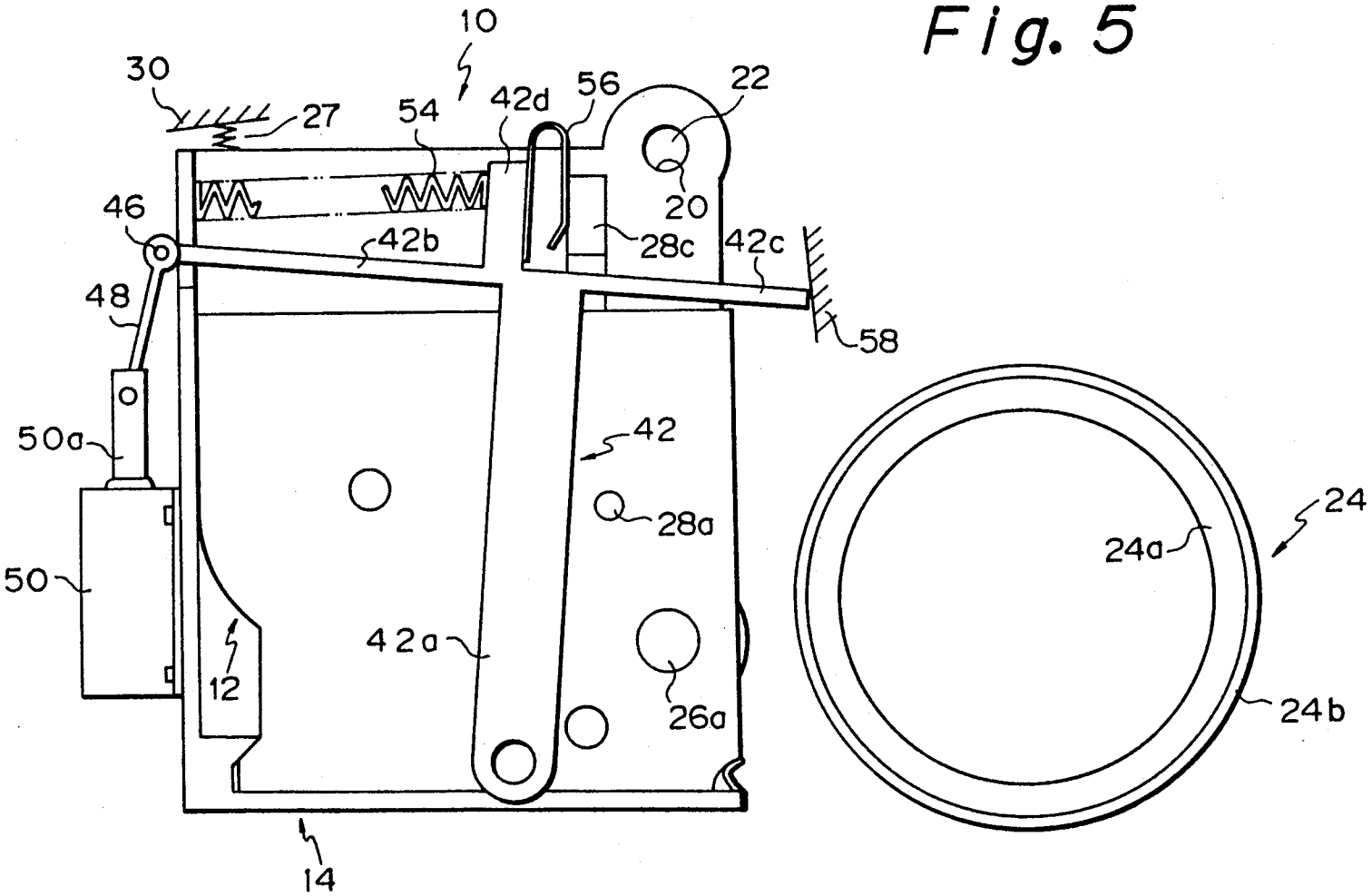
FIG. 5 is a view similar to FIG. 4, showing the solenoid actuator when de-energized.

During the developing operation, the solenoid actuator 50 is electrically energized so that the working rod 50*a* thereof is retracted, as shown in FIGS. 1 and 4. In this case, the developing roller 26 is pressed against the photosensitive drum 24 at the linear pressure of from about 22 to 50 g/cm by the coil springs 27, and the blade member is pressed against the developing roller 26 at the linear pressure of about 26 g/mm by the coil springs 32. On the other hand, when the developing operation is stopped, the solenoid actuator 50 is electrically de-energized and the working rod 50*a* is moved from the retracted position to an extended position by the coil springs 54, whereby the T-shaped lever members 42 are moved in the clockwise direction in FIGS. 1 and 4. This clockwise movement of the T-shaped lever members 42 results in an abutment of the arm portions 42*c* thereof against a portion 58 of the printer frame structure, so that the frame casing 14 is moved against a spring force of the coil springs 27 in the clockwise direction, as shown in FIG. 5, whereby the developing roller 26 is separated from the photosensitive drum 24. At the same time, the clockwise movement of the T-shaped lever members 42 also results in an abutment of the U-shaped leaf springs 56 against the extended portons 28*c* of the blade member 28, so that the blade member 28 is moved against a spring force of the coil springs 32 in the clockwise direction, whereby the blade member 28 is separated from the developing roller 26. Therefore, since pressures exerted on the developing roller 26 by the photosensitive drum 24 and the blade member 28, respectively, are released, the developing roller 26 is not subjected to plastic deformation.

The developing device 10 shown in FIGS. 1 to 5 is further characterized in that an electric motor 60 for driving the developing roller 26 is mounted on one of the side walls 14*b* of the frame casing 14, whereby the developing roller 26 can be stably and uniformly pressed against the photosensitive drum 24 at a given linear pressure. If the motor 60 is supported by the printer frame structure as in the conventional manner, the developing device 10 will be subjected to a twist motion by the drive force of the motor. Note, the drive motor 60 is operatively connected to the shaft 26*a* of the developing roller 26 through a gear train (not shown).

Figure 6:
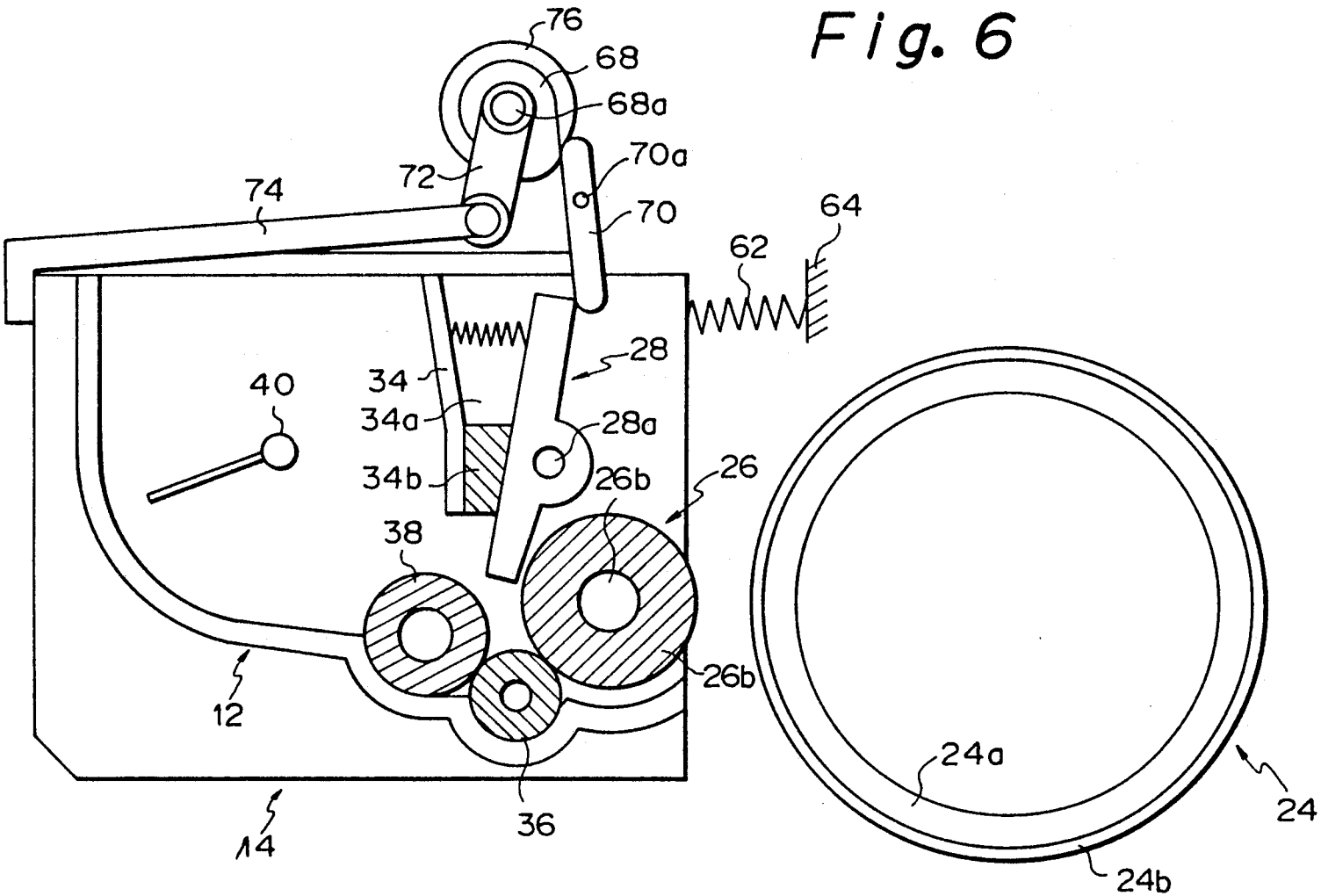
FIG. 6 is a schematic view showing another embodiment of a developing device according to the present invention, in which a rotary magnet actuator is de-energized.
Figure 7:
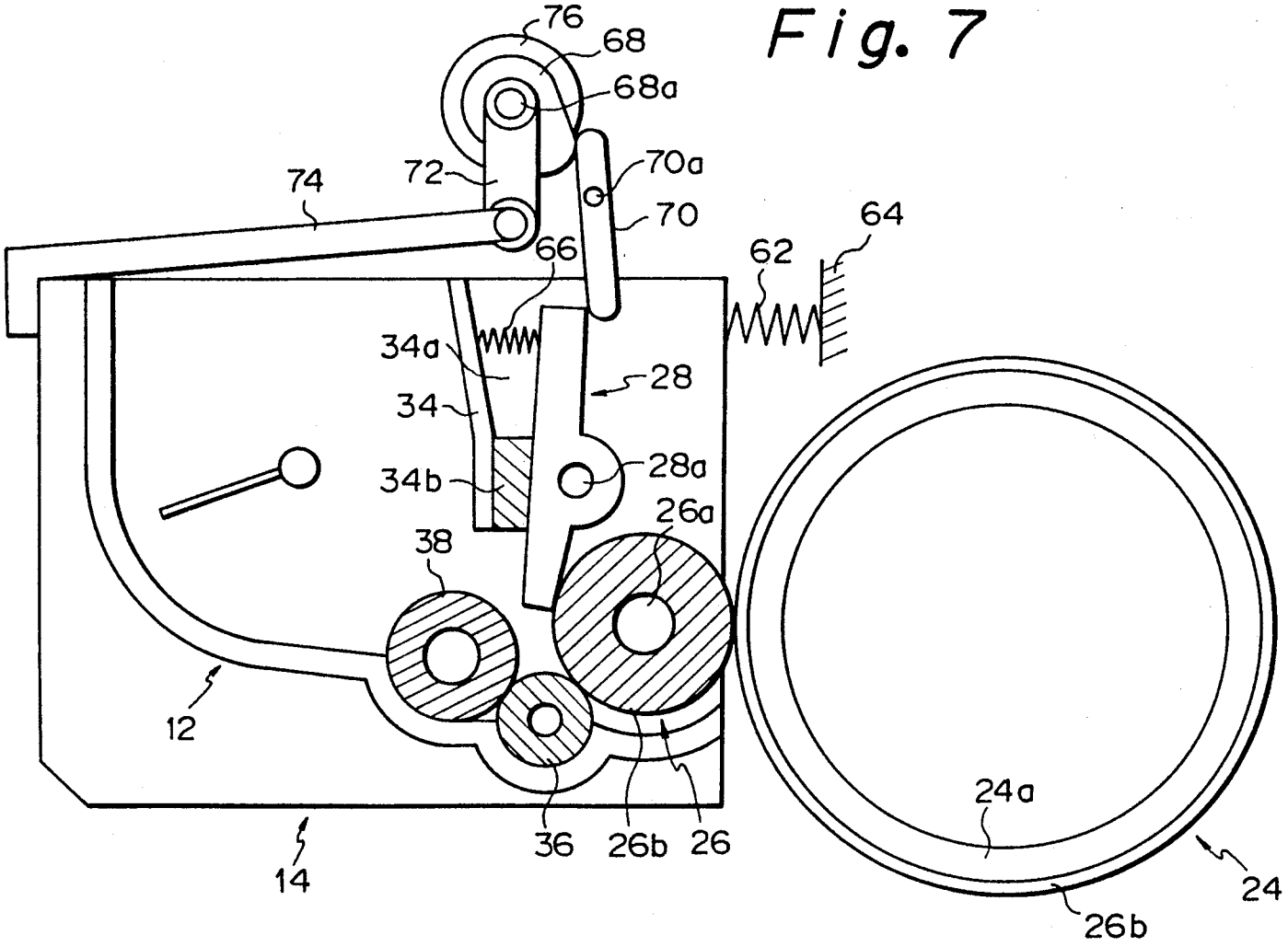
FIG. 7 is a view similar to FIG. 6, showing the rotary magnet actuator when energized.

FIGS. 6 and 7 show another embodiment of the developing device according to the present invention. The developing device per se of FIGS. 6 and 7 is substantially identical to that of FIGS. 1 to 5. In FIGS. 6 and 7, a stopper member 34*b* made of a foam rubber material or sponge material is disposed between the partition 34 and the blade member 28 so that the developer is prevented from entering the space 34*a* therebetween.

In the embodiment of FIGS. 6 and 7, the frame casing 14 is guided to be moved toward and away from a photosensitive drum 24. As shown in FIG. 6, a coil spring 62 is disposed between the frame casing 14 and a portion 64 of the printer frame structure so that the frame casing 14 is resiliently biased to a position shown in FIG. 6 in which the developing roller 26 is separated from the photosensitive drum 24. Also, a spring 66 is disposed between the blade member 28 and the partition 34 so that the blade member 28 is resiliently biased to a position shown in FIG. 6 in which the blade member 28 is separated from the developing roller 26.

The developing device of FIGS. 6 and 7 is provided with a cam/link mechanism including a cam element 68 securely mounted on a cam shaft 68*a* supported by the printer frame structure, and a two-arm element 70 is pivoted on a shaft 70*a*, which is also supported by the printer frame structure. One end of the two-arm element 70 is engaged with the cam element 68, and the other end thereof is engaged with the blade member 28, so that the two-arm element 70 is resiliently biased in the counterclockwise direction. The cam/link mechanism further includes an arm element 72 having one end securely attached to the cam shaft 68*a*, and a link element 74 having one end pivotally connected to the other end of the arm element 72. The other end of the link element 74 is formed as an L-shaped portion and is engaged with a back upper edge of the frame casing 14, as shown in FIGS. 6 and 7.

The cam/link mechanism is driven by a rotary magnet actuator 76 coupled to the cam shaft 68*a*. When the rotary magnet actuator 76 is electrically de-energized, the cam/link mechanism is in the condition shown in FIG. 6, due to the spring forces of the coil springs 62 and 66, and thus the developing roller 26 is separated from the photosensitive drum 24 and the blade member 28 is separated from the developing roller 26. When the developing operation is started, the rotary magnet actuator 76 is electrically energized so that the arm element 72 is moved from a position shown in FIG. 6 to the position shown in FIG. 7, whereby the frame casing 14 is moved toward the photosensitive drum 24, against the spring force of the coil spring 62, and thus the developing roller 28 is pressed against the photosensitive drum 24 at a given linear pressure. Also, during the energization of the rotary magnet actuator 76, the cam element 68 is moved from a position shown in FIG. 6 to the position shown in FIG. 7, and accordingly, the two-arm element 70 is moved against the spring force of the coil spring 66 in the clockwise direction, and thus the blade member 28 is pressed against the developing roller 26 at a given linear pressure. Namely, when the developing operation is stopped, by electrically de-energizing the rotary magnet actuator 76, the pressures exerted on the developing roller 26 by the photosensitive drum 24 and the blade member 28, respectively, can be released.

Figure 8:
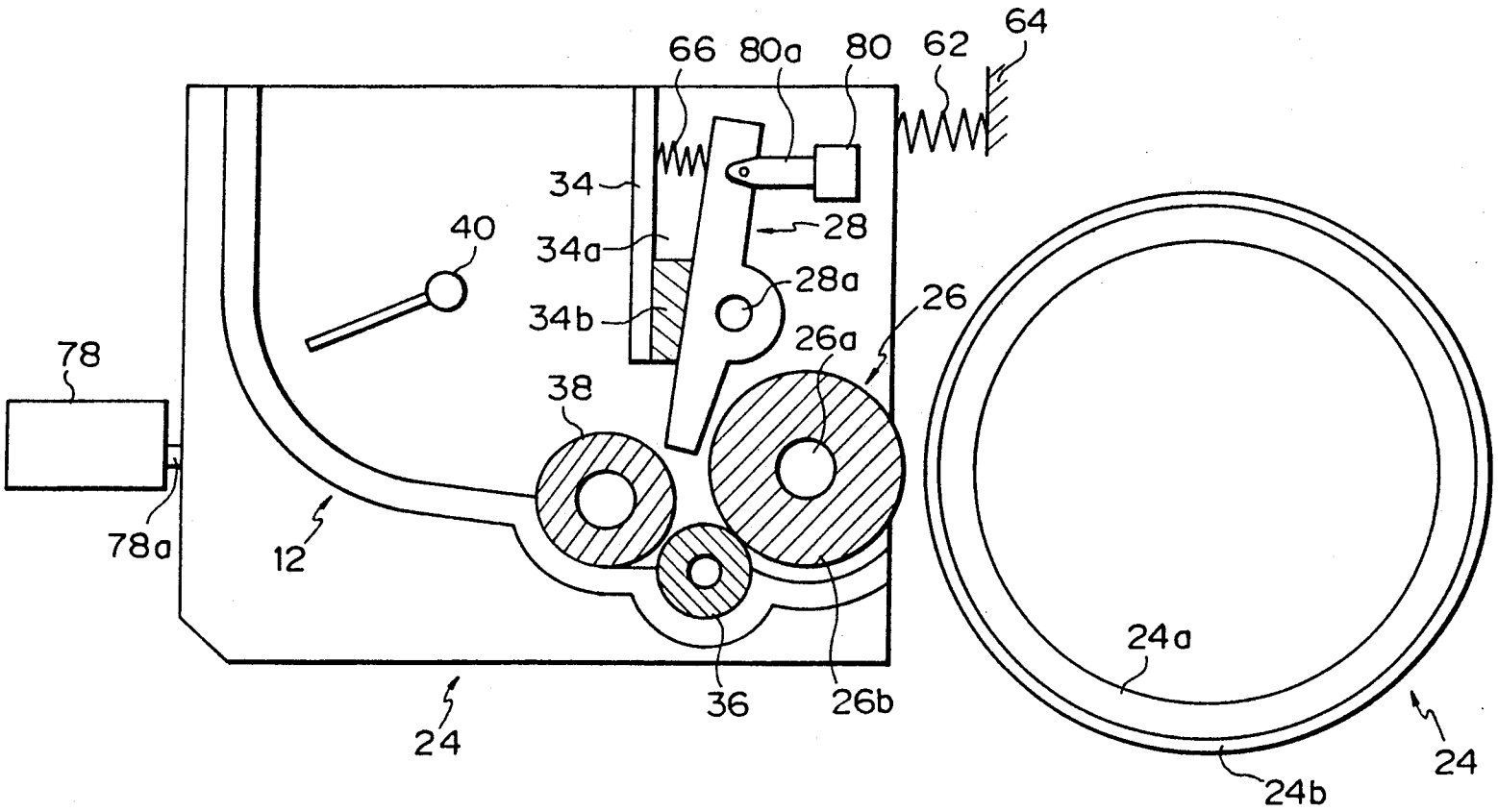
FIG. 8 is a view showing a modification of the embodiment of FIGS. 6 and 7, in which two solenoid actuators are de-energized.
Figure 9:
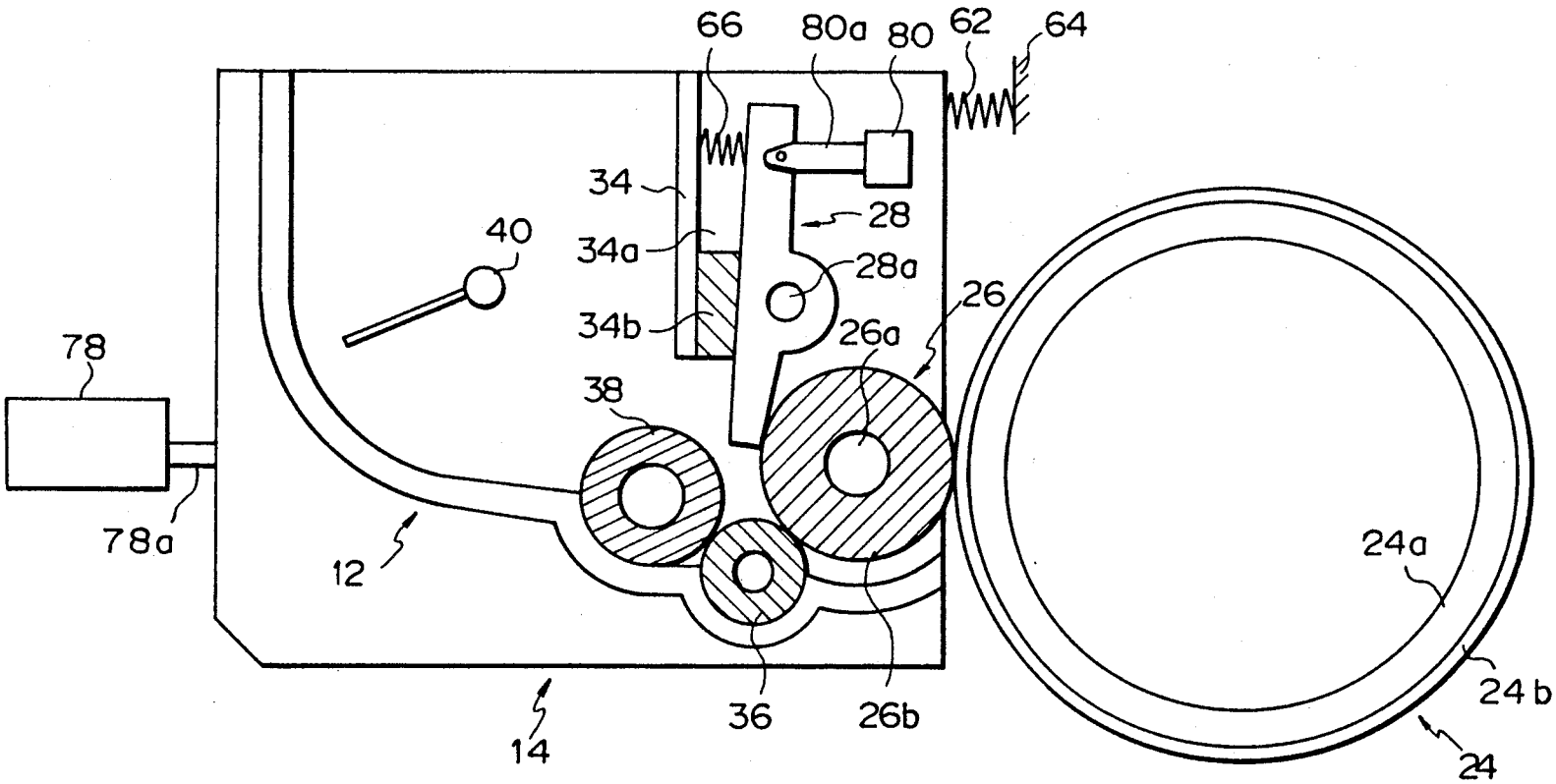
FIG. 9 is a view similar to FIG. 6, showing the two solenoid actuators when energized.

FIGS. 8 and 9 show a modification of the embodiment of FIGS. 6 and 7, in which two solenoid actuators 78 and 80 are used in place of the cam/link mechanism shown in FIGS. 6 and 7. The solenoid actuator 78 is supported by the printer frame structure, and a working rod 78*a* thereof is connected to the back wall of the frame casing 14. When the solenoid actuator 78 is electrically de-energized, the working rod 78*a* is retracted by the spring force of the coil spring 62, and thus the frame casing 12 is resiliently biased to the position shown in FIG. 8 by the coil spring 62 whereby the developing roller 26 is separated from the photosensitive drum 24. The solenoid actuator 80 is supported by the frame vessel 12, and a working rod 80*a* thereof is pivotally connected to the blade member 28. When the solenoid actuator 80 is electrically de-energized, the working rod 80*a* is retracted by the spring force of the coil spring 66, and thus the blade member 28 is resiliently biased to the position shown in FIG. 8 to be thereby separated from the developing roller 26. When the developing operation is started, the solenoid actuators 78 and 80 are electrically energized so that the working rods 78*a* and 80*a* are extended from the positions shown FIG. 8 to the positions shown in FIG. 9, respectively, whereby the developing roller 26 is pressed against the photosensitive drum 24 at a given linear pressure and the blade member 28 is pressed against the developing roller 26 at a given linear pressure. With the arrangement mentioned above, when the solenoid actuators 78 and 80 are electrically de-energized, the pressures exerted on the developing roller 26 by the photosensitive drum 24 and the blade member 28, respectively, can be released.

Figure 10:
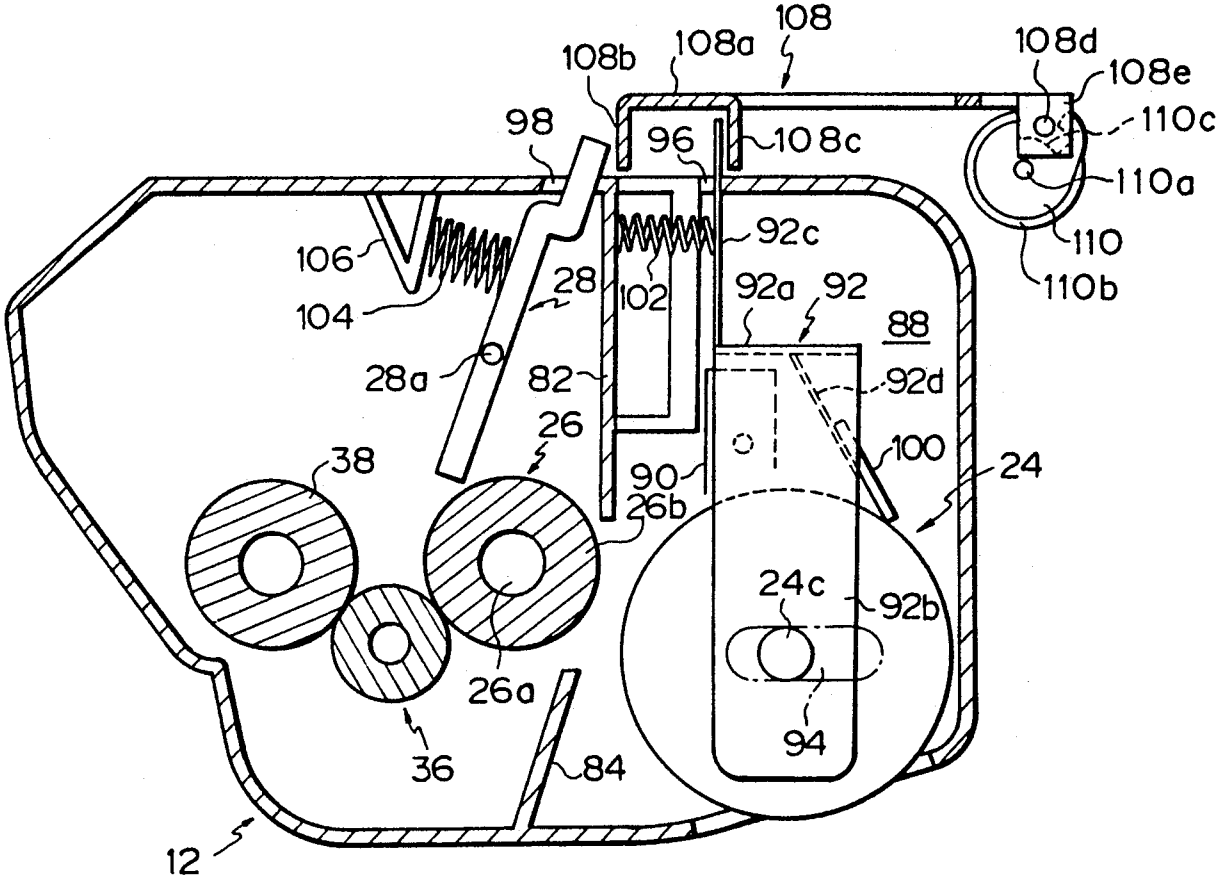
FIG. 10 is a schematic view showing yet another embodiment of a developing device according to the present invention, in which a rotary magnet actuator is de-energized.
Figure 13:
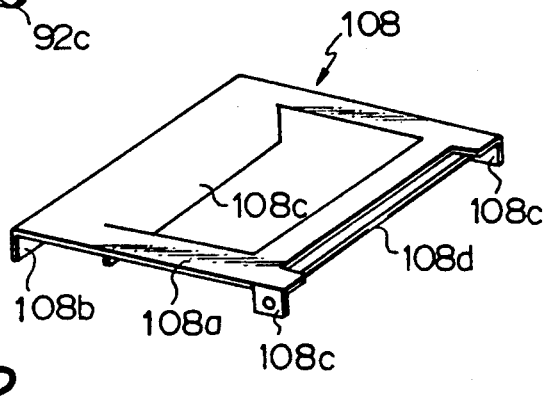
FIG. 13 is a perspective view showing a frame lever of the developing device of FIG. 10.
Figure 14:
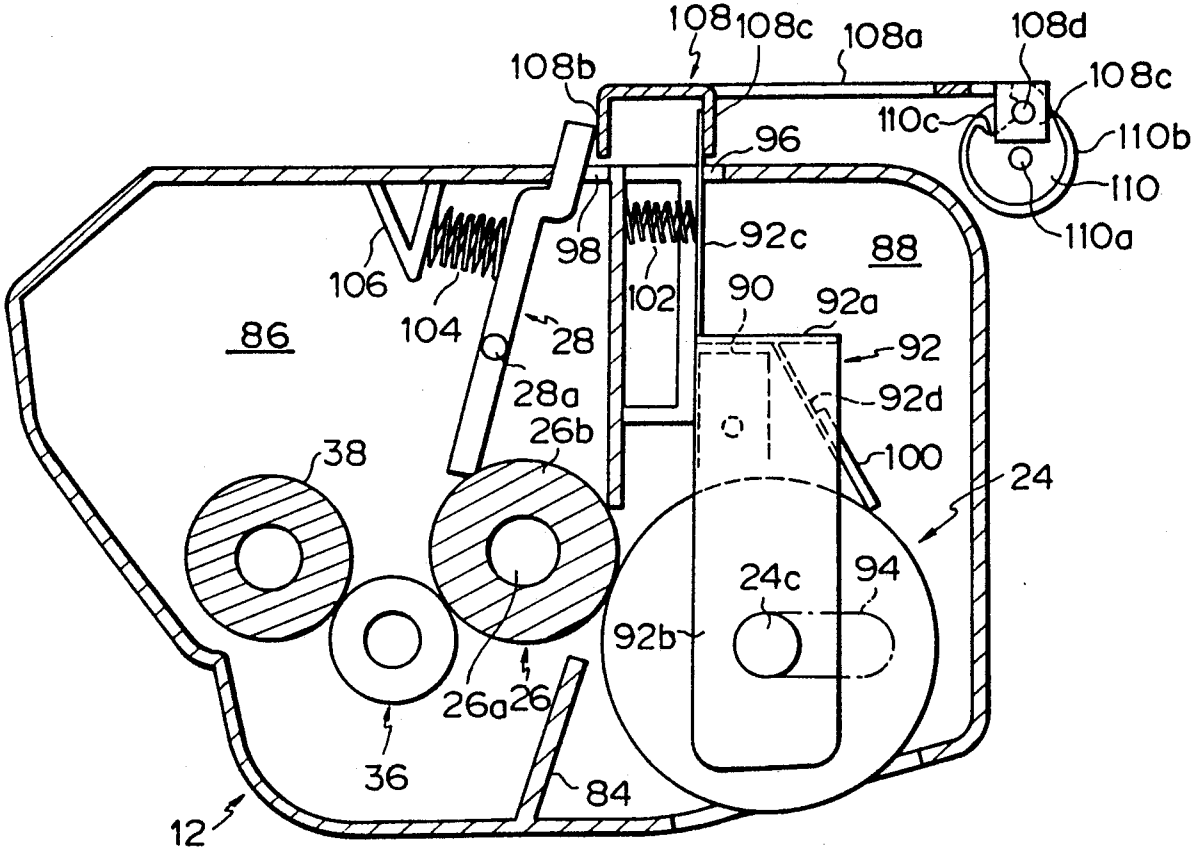
FIG. 14 is a view similar to FIG. 10, showing the rotary magnet when actuator energized.

FIGS. 10 to 14 show yet another embodiment of the developing device according to the present invention, which is assembled together with the photosensitive drum 24 as one unit. In this embodiment, the vessel 12 per se is detachably mounted in place in the printer frame structure, and is provided with partitions 82 and 84 by which an interior of the vessel 12 is divided into a developer storage chamber 86 and a drum chamber 88. Namely, in this embodiment, only the portion 86 of the vessel 12 holds the developer. The developing roller 26, the blade member 28, the toner-removing roller 36, and the paddle roller 38' are provided within the developer storage chamber 86, and the photosensitive drum 24 is provided within the drum chamber 88. A portion of the developing roller 26 is exposed from a space between the partitions 82 and 84 and faces the photosensitive drum 24. In FIGS. 10 and 14, 90 indicates a corona discharger provided within the drum chamber 88 and by which a uniform distribution of electrical charges is produced on the surface of the photoconductive drum 24. Note, although not shown in FIGS. 10 and 14, the optical writing means such as the LED array for writing an electrostatic latent image on the charged surface of the photoconductive drum 24 is also provided within the drum chamber 88.

Figure 11:
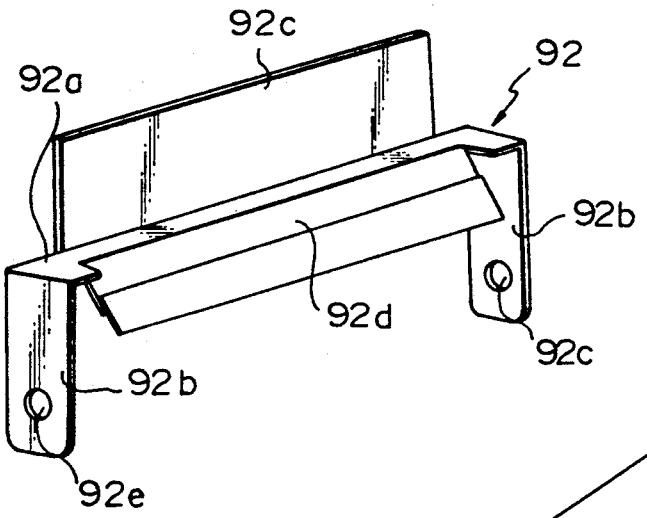
FIG. 11 is a perspective view showing a movable frame for a photosensitive drum of the developing device of FIG. 10.

In the embodiment of FIGS. 10 to 14, the photosensitive drum 24 is supported by a movable frame 92. As shown in FIG. 11, the movable frame 92 includes a generally rectangular top plate 92*a*, a pair of side plates 92*b* extended downward from short sides of the top plate 92*a*, an upright plate 92*c* extended upward from one of longer sides of the top plate 92*a*, and a flap-like plate element 92*d* integrally formed along the other longer side of the top plate 92*a*. Each of the side plates 92*b* has a through hole 92*e* formed therein near the lower end thereof, and the photosensitive drum 24 has stub shafts 24*c* projected from the end faces thereof and having a diameter somewhat smaller than that of the through hole 92*e*. Accordingly, the photosensitive drum 24 is rotatably supported between the side plates 92*b* by inserting the stub shafts 24*c* into the through holes 92*e*, respectively.

Figure 12:
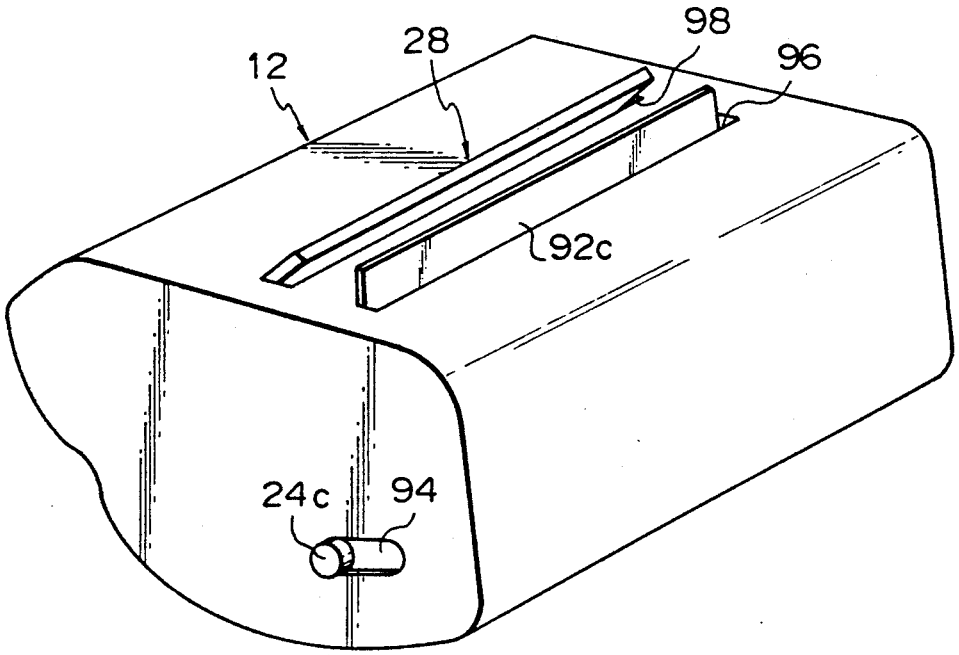
FIG. 12 is a perspective view showing a vessel of the developing device of FIG. 10.

The vessel 12 has the appearance as shown in FIG. 12, and is provided with a pair of elongated openings or slots 94 formed in side walls thereof. Note, only one of the elongated openings or slots 94 is shown in FIG. 12. The vessel 12 is also provided with two elongated rectangular openings 96 and 98 formed in a top walls thereof and disposed in parallel to each other. The movable frame 92 with the photosensitive drum 24 supported thereby is arranged within the drum chamber 88 of the vessel 12 in such a manner that the stub shafts 24*c* of the photosensitive drum 24 are inserted into the elongated slots 94 while the upright plate 92*c* is partially projected out of the elongated rectangular opening 96. The blade member 28 is also arranged within the developer storage chamber in such a manner that a top portion of the blade member 28 is projected out of the elongated rectangular opening 98.

Note, a scraper element 100 is attached to the flap-like plate element 92*d* of the movable frame 92, and is engaged with the photosensitive drum 24 to remove residual toner particles (not transferred to a sheet or paper during the toner image-transferring process) from the surface thereof.

As shown in FIG. 10, a coil spring 102 is disposed between the partition 82 and the upright plate 92*c* of the movable frame 92, so that the movable frame 92 is resiliently biased to a position shown in FIG. 10, whereby the photosensitive drum 24 is separated from the developing roller 26. Also, a coil spring 104 is disposed between the blade member 89 and a support element 106 fixed on an inner surface of the top wall of the vessel 12, so that the blade member 28 is resiliently biased in the clockwise direction to be separated from the developing roller 26.

In this embodiment, the developing device is provided with a cam/lever mechanism including a frame lever 108, and a cam element 110 operatively connected thereto. As shown in FIG. 13, the frame lever 108 has a rectangular frame appearance, and includes a frame 108*a*, a first front abutment plate 108*b* extended downward from a front edge of the frame 108*a*, a second front abutment plate 108*c* extended downward from the frame 108*a* at the rear side of the first front abutment plate 108*b*, and a rod element 108*d* extended along the rear edge of the frame 108*a*, the ends of the rod element 108*d* being securely joined to piece elements 108*e* extended downward from the rear side corners of the frame 108*a*. As shown in FIG. 10, the frame lever 108 is provided on the top wall of the vessel 12 in such a manner that the front faces of the first and second front abutment plates 108*b* and 108*c* face the top of the blade member 28 and the upright plate 92*c* of the movable frame 92. The cam element 110 is securely mounted on a shaft 110*a* supported by the printer frame structure and coupled to a rotary magnet actuator 110*b*, and has a cam slot 110 formed therein, in which the rod element 108*d* of the frame lever 108 is received.

When the rotary magnet actuator 110*b* is electrically de-energized, the frame lever 108 is resiliently biased to a position shown in FIG. 10 by the spring forces of the coil springs 102 and 104, so that the photosensitive drum 24 and the blade member 28 are separated from the developing roller 26, as shown in FIG. 10. When the developing operation is started, the rotary magnet actuator 110*b* is electrically energized so that the cam element 110 is driven in the counterclockwise direction, whereby the frame lever 108 is moved from the position shown in FIG. 10 to a position shown in FIG. 14, so that the movable frame 98 and the blade member 28 are moved against the spring forces of the coil springs 102 and 104, respectively, and accordingly, the photosensitive drum 24 and the blade member 28 are pressed against the developing roller 26 at given linear pressures, respectively. When the developing operation is stopped, by electrically de-energizing the solenoid actuators 78 and 80, the pressures exerted on the developing roller 26 by the photosensitive drum 24 and the blade member 28, respectively, are released.

Figure 15:
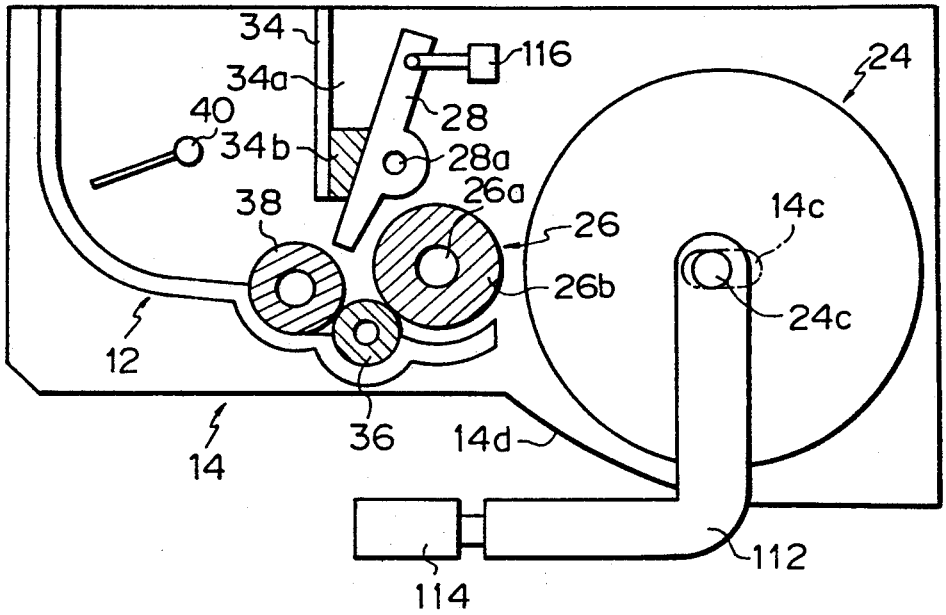
FIG. 15 is a schematic view showing yet another embodiment of a developing device according to the present invention, in which two solenoid actuators are de-energized.
Figure 16:
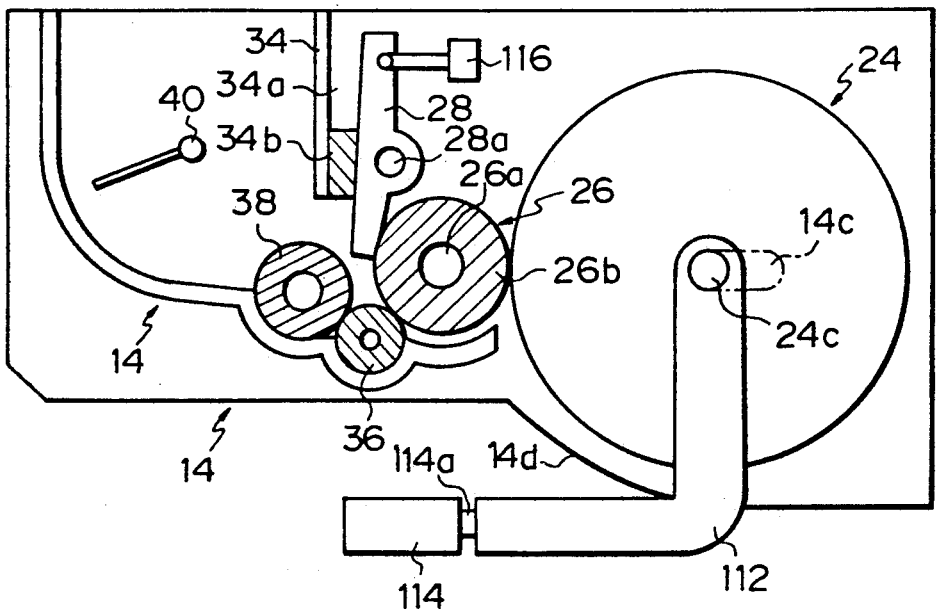
FIG. 16 is a view similar to FIG. 15, showing the two solenoid actuators when energized.

FIGS. 15 and 16 show yet another embodiment of the developing device according to the present invention, which is also assembled together with the photosensitive drum 24 as a unit. In this embodiment, the vessel 12 is fixed to the frame casing 14, which is detachably mounted in place in the printer frame structure, and has an expanded portion 14*d* in which the photosensitive drum 24 is received, as shown in FIGS. 15 and 16. Although not illustrated, the corona discharger for producing a uniform distribution of electrical charges on the surface of the photoconductive drum 24, the optical writing means such as the LED array for writing an electrostatic latent image on the charged surface of the photoconductive drum 24, and other elements are also provided within the expanded portion 14*d* of the frame casing 14.

In the embodiment of FIGS. 15 and 16, the photosensitive drum 24 is supported by inserting the stub shafts 24*c* into elongated slots 14*e* formed in side walls of the expanded portion 14*d*, so that the photosensitive drum 24 is movable toward and away from the developing roller 26. An end of each stub shaft 24*c* is projected out of the corresponding elongated slot 14*e*, and is rotatably connected to one end of an L-shaped arm member 112. A solenoid actuator 114 is supported by the printer frame structure or the frame casing 14, and a working rod 114*a* thereof is coupled to the other end of the L-shaped arm member 112. When the solenoid actuator 114 is electrically de-energized, the working rod 114*a* thereof is extended so that the photosensitive drum 24 is separated from the developing roller 26, as shown in FIG. 15. On the other hand, the stopper member 34*b* disposed between the blade member 28 and the partition 34 is made of a rubber material having a high elasticity, so that the blade member 28 is resiliently biased to a position shown in FIG. 15. A solenoid actuator 116 is supported by the frame casing 14 or the printer frame structure, and a working rod 116*a* thereof is pivotally coupled to the blade member 28. When the solenoid actuator 116 is electrically de-energized, the working rod 116*a* thereof is retracted so that the blade member 28 is maintained at the position shown in FIG. 15 to be separated from the developing roller 28.

When the developing operation is started, the solenoid actuators 114 and 116 are electrically energized so that the working rod 114*a* is retracted while the working rod 116*a* is extended, whereby the photosensitive drum 24 and the blade member 28 are pressed against the developing roller 26. When the developing operation is stopped, by electrically energizing the solenoid actuators 114 and 116, the pressures exerted on the developing roller 26 by the photosensitive drum 24 and the blade member 28, respectively, can be released.

Note, in the embodiments mentioned above, the pressures exerted on the developing roller may be partially released or reduced to a level at which the prevention of the plastic deformation of the developing roller can be ensured, with the developing roller being in contact with the photosensitive drum and the blade.

Figure 17:
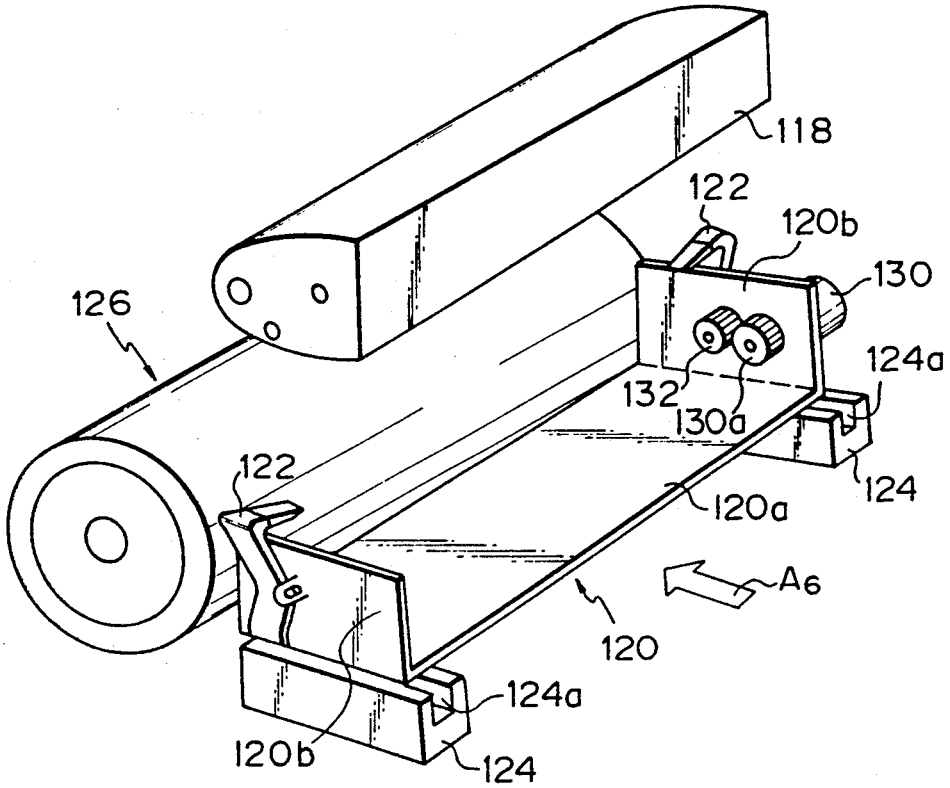
FIG. 17 is a perspective view showing an embodiment of a developing device according to another aspect of the present invention.
Figure 18:
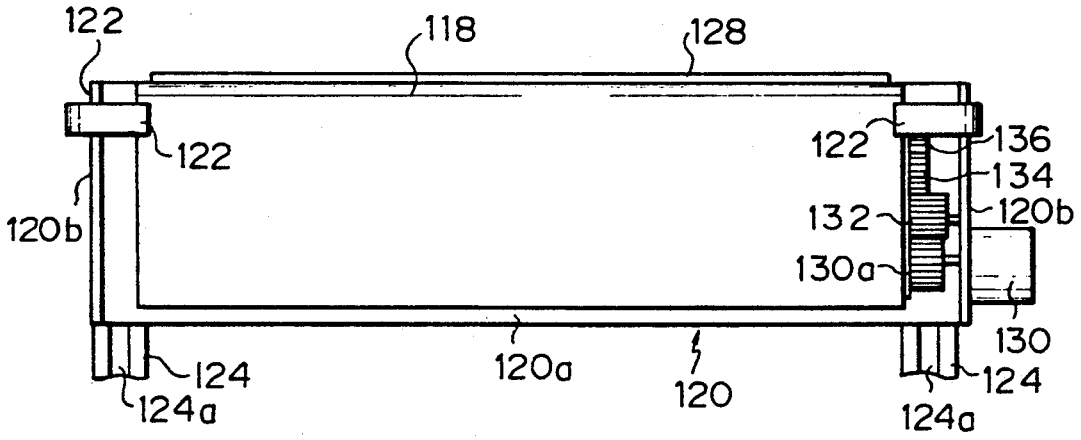
FIG. 18 is a plan view of FIG. 17.

FIGS. 17 and 18 show an embodiment of the developing device constructed according to another aspect of the present invention.

In this embodiment, the developing device comprises a vessel 118 for holding the non-magnetic type one-component developer, in which a developing roller, a blade member, a toner-removing roller, and other elements are arranged in substantially the same manner as mentioned above. The developing device also comprises a movable frame 120 for receiving the vessel 118. The frame 120 is comprised of a rectangular plate 120*a*, and a pair of side walls 120*a* extended upward from shorter sides of the rectangular plate portion 120*a*. Each of the side walls 120*b* is provided with a pawl element 122 resiliently biased inward by a suitable spring (not shown) such as a torsion spring. When the vessel 118 is received in the frame 120, the pawls 122 are engaged with the vessel 118, as shown in FIG. 18, and thus it is immovably held in the movable frame 120.

The frame 120 bridges a pair of guide rails 124, each of which has a guide groove 124*a* formed therein, and is provided with guide rollers or slider elements (not shown) engaged in the guide grooves 124*a*, whereby the frame 120 is movable toward and away from a photosensitive drum 126 installed at a fixed position. Note, the photosensitive drum 126 is also constructed in substantially the same manner as mentioned above. The vessel 118 or the frame 120 is resiliently baised by a suitable spring (not shown) in a direction indicated by an arrow $A_6$, whereby the developing roller (a portion thereof is indicated by reference numeral 128 in FIG. 18) is pressed against the photosensitive drum 126.

The developing device of FIGS. 17 and 18 is characterized in that an electric motor 130 for driving the developing roller 128 is mounted on one of the side walls 120*b* of the frame 120. In particular, the motor 130 is attached to the outer wall surface of the side wall 120*b* concerned, with an output shaft of the motor 130 passing therethrough. An output gear 130*a* is fixed to the end of the motor shaft, and is engaged with a gear 132 attached to the inner wall surface of the side wall 120*b* concerned. The gear 132 is then engaged with a gear 134 attached to the corresponding side wall of the vessel 118, and thus the gear 134 is engaged with a gear 136 attached to the corresponding end of a shaft of the developing roller shaft 138. With this arrangement, the developing roller can be stably and reliably driven because the movable developing device per se is provided with the motor mounted thereon.

Figure 19:
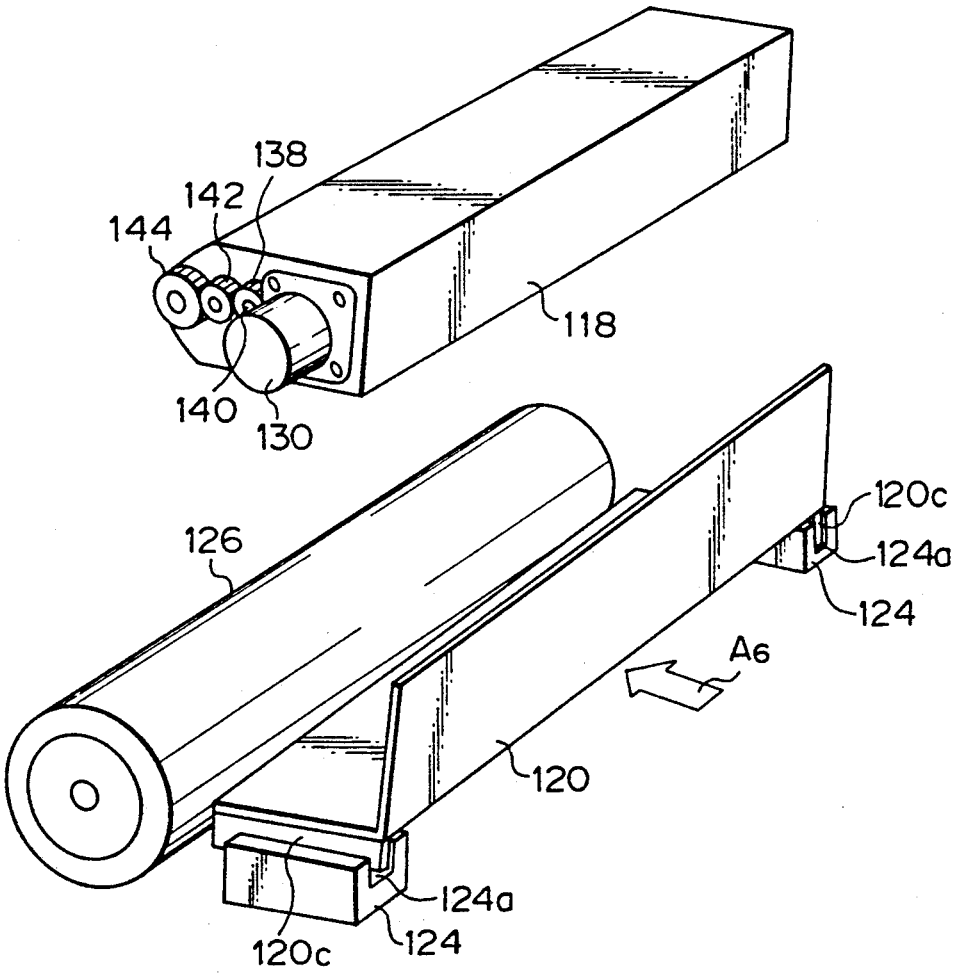
FIG. 19 is a perspective view showing a modification of the embodiment of FIG. 17

FIG. 19 shows a modification of the embodiment shown in FIGS. 17 and 18, which is characterized in that the motor 130 is mounted on one of the side walls of the vessel 118. An output shaft of the motor 130 passes through the side wall concerned of the vessel 118, and an output gear (not visible) is fixed to the end of the motor shaft. The output gear is engaged with a gear (also not visible) attached to the inner wall surface of the side wall concerned of the vessel 118 and having a shaft passing therethrough. This shaft also has a gear 138 fixed on the outer end thereof, as indicated by reference numeral 140 in FIG. 19. The gear 138 is engaged with a gear 142 attached to the outer wall surface of the side wall concerned of the vessel 118, and the gear then engaged with a gear 144 attached to the corresponding end of a shaft of the developing roller shaft. Note, the gears provided within the vessel 118 are preferably covered, to be protected from an ingress of the toner particles. The vessel 118 with the motor 130 is received in the movable frame 120 and is immovably held therein by a releasable fixture. In this modified embodiment, since the movable developing device per se is also provided with the motor mounted thereon, the developing roller can be stably and reliably driven. Note, in FIG. 19, the slider element engaged in each guide groove 124*a* is indicated by reference numeral 120*c*.

Figure 20:
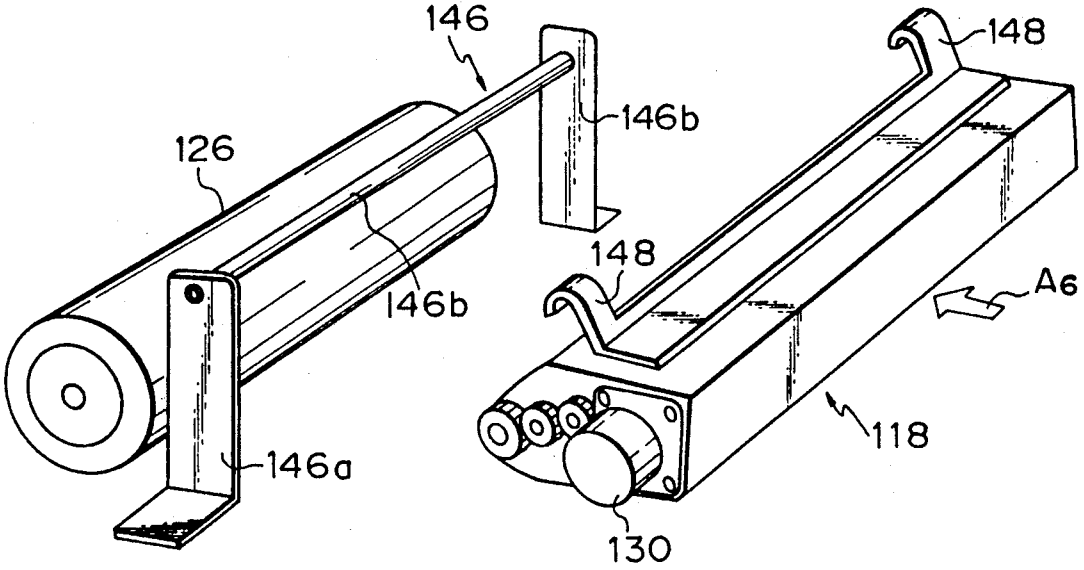
FIG. 20 is a perspective view showing a modification of the embodiment of FIG. 19.
Figure 21:
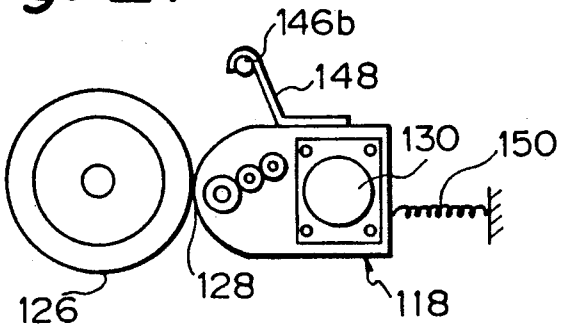
FIG. 21 is a side view of FIG. 20.

FIGS. 20 and 21 also show a modification of the embodiment of FIG. 19, in which the motor 130 and the gears associated therewith are arranged in the same manner as in FIG. 19. In this modified embodiment, a fixed frame 146 is used in place of the movable frame 140, and includes a pair of bracket elements 146*a* disposed near the end face of the photosensitive drum 126, and a bar element 146*b* extended between the bracket elements 146*a*. The vessel 118 has a pair of hook elements 148 extended upward from the top wall of the vessel 118, and is swingably suspended from the bar elements 146*b* by engaging the hook elements 146 therewith, as shown in FIG. 21. The vessel 118 is resiliently biased by a coil spring 150 (FIG. 12) in the direction of the arrow $A_6$, whereby the developing roller 128 is pressed against the photosensitive drum 126.

FIGS. 22 to 27 show an embodiment of the developing device constructed according to yet another aspect of the present invention. This developing device is characterized by a means for detecting a lack of the developer, and is simply and economically constructed according to the invention.

In the embodiments of FIGS. 22 to 27, the developing device comprises a vessel 152 for holding the non-magnetic type one-component developer, in which a developing roller 154, a blade member 156, and a toner-removing roller 158 are arranged in substantially the same manner as mentioned above, and further, a phososensitive drum 159 is constructed in substantially the same manner as mentioned above. Note, in FIGS. 22, 25, 26, and 27, the toner particles are symbolically shown by small open circles.

Figure 22:
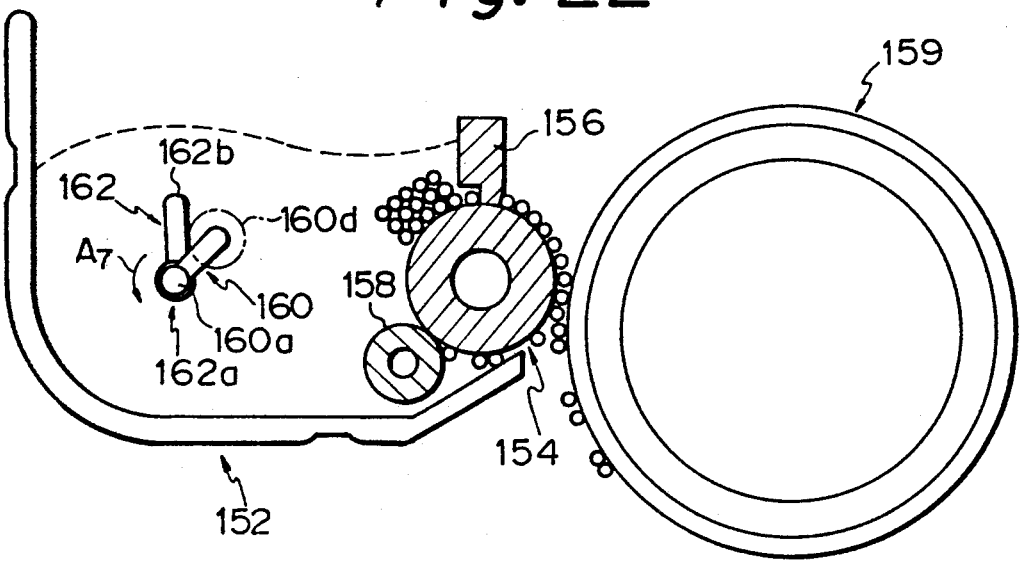
FIG. 22 is a schematic view showing an embodiment of a developing device according to yet another aspect of the present invention.
Figure 23:
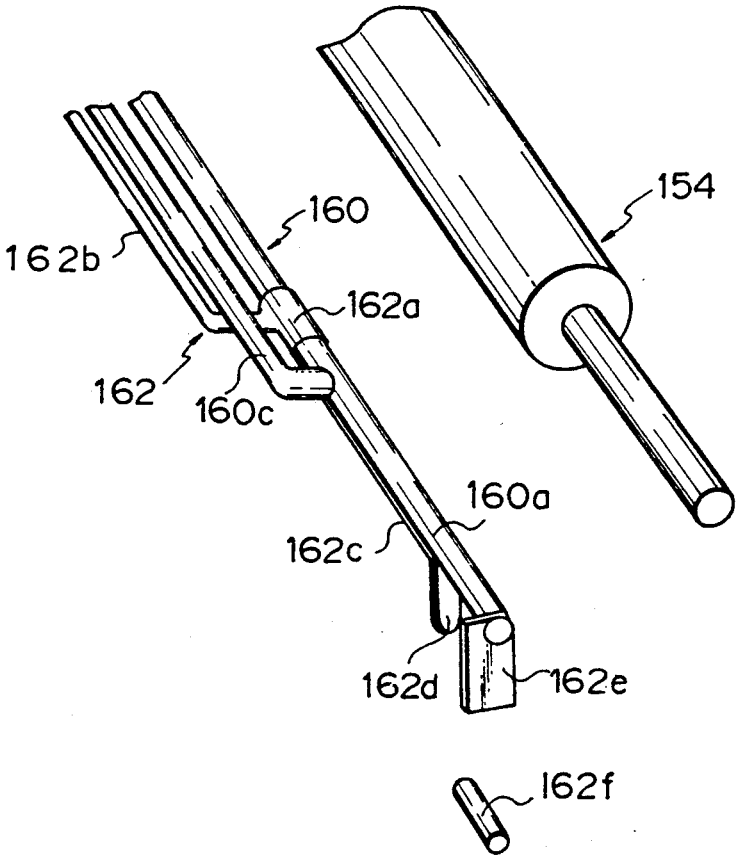
FIG. 23 is a perspective view showing parts of the developing device of FIG. 22.
Figure 24:
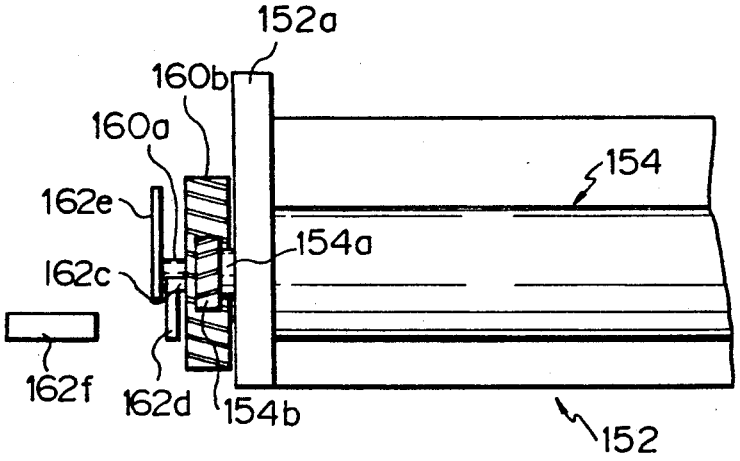
FIG. 24 is a view taken along a line X—X of FIG. 22.

The developing device of FIGS. 22 to 27 further comprises an agitator 160 provided within the vessel 152 for agitating the toner developer as mentioned above. The agitator 160 includes a shaft 160*a*, an end of which passes through a side wall 152*a* of the vessel 152, and has a gear 160*b* fixed thereon, as shown in FIG. 24. The developing roller 154 includes a shaft 154*a*, an end of which also passes through the side wall 152*a* of the vessel 152 and has a gear 154*b* fixed thereon. The gear 154*b* is operatively connected to the gear 160*b* through a gear train (not shown in FIG. 24) whereby, during the rotation of the develping roller 154, the shaft 160*a* of the agitator 160 is rotated in a direction indicated by arrow $A_7$ in FIG. 22. The agitator 160 also includes an rod-like agitating element 160*c*, radially bent and joined to the shaft 160*a*, as shown in FIG. 23. By rotating the shaft 160*a* with the rod-like agitating element 160*c*, the developer can be effectively agitated in the vessel 152. The agitating element 160*c* may be provided with a coil wire 160*d*, illustrated by a chain line in FIG. 22, whereby the agitation of the developer can be facilitated.

As mentioned above, the developing device of FIGS. 22 to 27 is characterized by the lack of developer detecting means incorporated into the agitator 160, and generally indicated by reference numeral 162. In particular, the lack of developer detecting means 162 includes a pair of sleeve elements 162*a* loosely fitted over the shaft 160*a* of the agitator 160, and a rod-like element 162*b* having radially bent ends and joined to the sleeve elements 162*a*. Note, in FIG. 23, only one of the sleeve elements 162*a* is illustrated. The lack of developer detecting means 162 also includes a gutter-like element 162*c* extended from an end edge of the sleeve element 162*a* (i.e., that illustrated) along the agitator shaft 160*a*, as shown in FIG. 23. The gutter-like element 162*c* also passes thorugh the side wall 152*a* of the vessel 152, and has a tongue element 162*d* suspended from the end thereof which projects from the side wall 152*a* of the vessel 152. The lack of developer detecting means 162 further includes a small plate element 162*e* attached to the end of the agitator shaft 160*a*, as best shown in FIG. 23. When the agitator shaft 160*a* is rotated as mentioned above, the rod-like agitating element 160*c* (or the coil wire 160*d*) is abutted against the rod-like element 162*b*, so that the rod-like element 162*b* is also rotated together with the agitator shaft 160*a*, resulting in a rotation of the tongue element 162*d* about the longitudinal axis of the agitator shaft 160*a*. The attachment of the small plate element 162*e* to the end of the agitator shaft 160*a* is performed in such a manner that the small plate element 162*e* is aligned with the tongue element 162*d* along the longitudinal axis of the agitator shaft 160*a* while the rod-like element 162*b* is rotated together with the agitator shaft 160*a*, as shown in FIGS. 23 and 25

Figure 25:
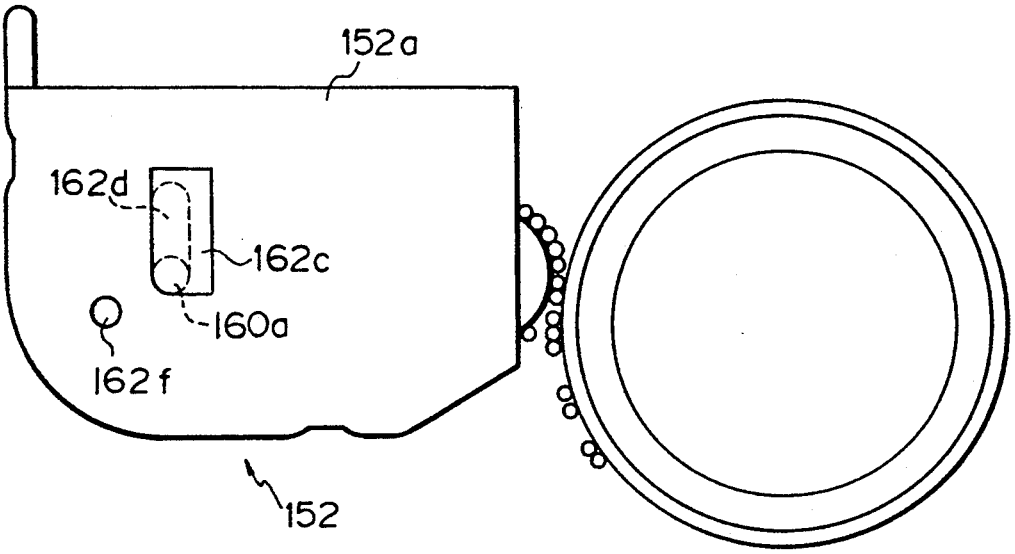
FIG. 25 is a view similar to FIG. 22, showing a positional relationship among a tongue element, a small plate element, and photo-sensor.

Furthermore, the lack of developer detecting means 162 includes a well known type of photo-sensor 162*f* provided at the outside of the vessel side wall 152*a*, as shown in FIGS. 24 and 25, and supported by the vessel 152 or the printer frame structure. The photo-sensor 162*f* is positioned at a slightly higher level than that of the inner bottom surface of the vessel 152 and at a location on a circle drawn by the end of the tongue element 162*d* during the rotation thereof. The photo-sensor 162*f* emits a light, and when the emitted light is reflected back, the photo-sensor 162*f* detects the reflected light. Note, the small plate element 162*d* has a non-reflective surface, whereas the tongue element 162*f* has a reflective surface.

Figure 26:
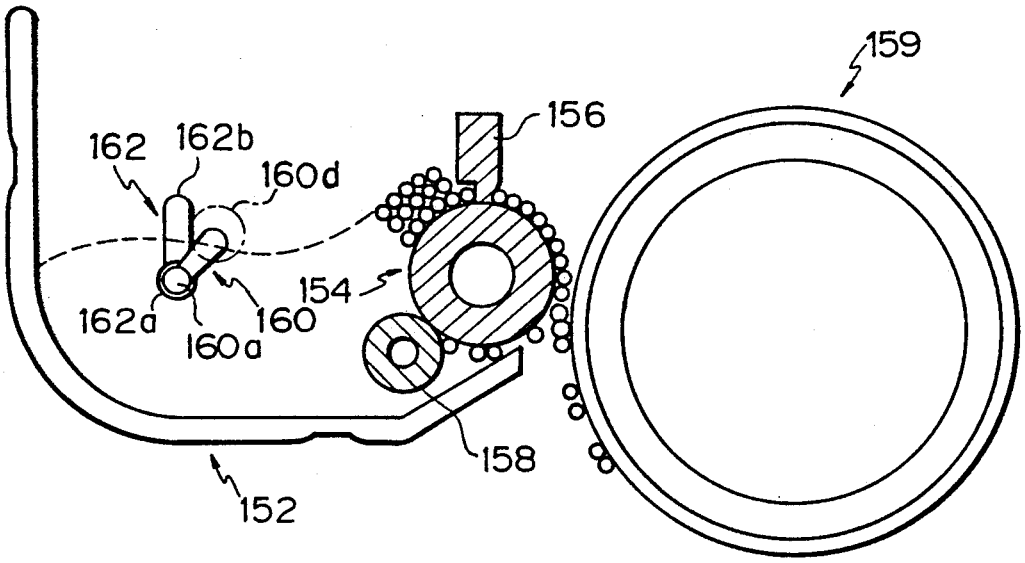
FIG. 26 is a view similar to FIG. 22, showing the developing device at a different developer consumption level.
Figure 27:
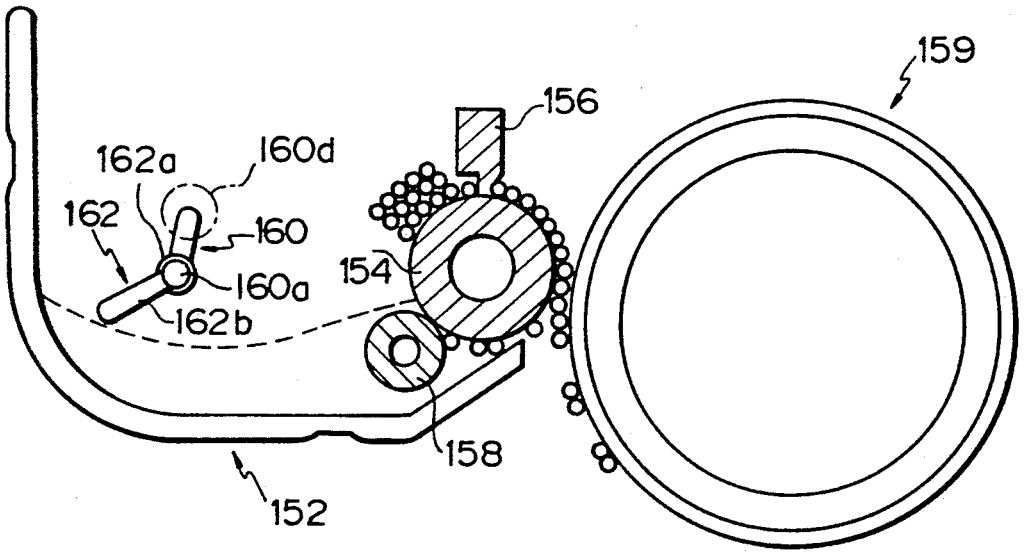
FIG. 27 is a view similar to FIG. 22, showing the developing device at a further different developer consumption level.

In operation, when a sufficient amount of the developer is held in the vessel 152, as shown by a broken line in FIG. 22, the rod-like element 162*b* is rotated together with the agitator shaft 160*a* so that the alignment of the tongue element 162*d* with the small plate element 162*e* is maintained during the rotation thereof. Accordingly, the photo-sensor 162 cannot detect the reflected light because the small plate element intervenes between the tongue element 162*d* and the photo-sensor 162. Also, even though some developer is consumed due to the development of the latent image, as shown in FIG. 26, the rod-like element 162*b* can be rotated together with the agitator shaft 160*a*, and thus the photo-sensor 162 cannot detect the reflected light. Nevertheless, when a large amount of the developer is consumed as shown in FIG. 27, the rod-like element 162*b* cannot be partially rotated together with the agitator shaft 160*a*. In particular, during the rotation of the rod-like element 162*b* from the bottom dead point to the top dead point, the rod-like element 162*b* is lifted up by the agitating element 160*c*, but just after the rod-like element 162*b* passes the top dead point, the rod-like element 162*b* falls down toward the bottom dead point, due to the force of gravity, at a speed higher than the rotational speed of the agitating element 160*c*. In this case, since the small plate element 162*e* cannot intervene between the tongue element 162*d* and the photo-sensor 162*f*, the photo-sensor 162*f* can detect the light reflected from the tongue element 162*d*. For example, the printer may be constructed so that an alarm is raised when the reflected light is detected, and thus the operator is informed that there is a lack of the developer.

FIGS. 28 to 31 show an embodiment of the developing device constructed according to yet another aspect of the present invention. This developing device is characterized by a seal arrangement for the developer.

Figure 28:
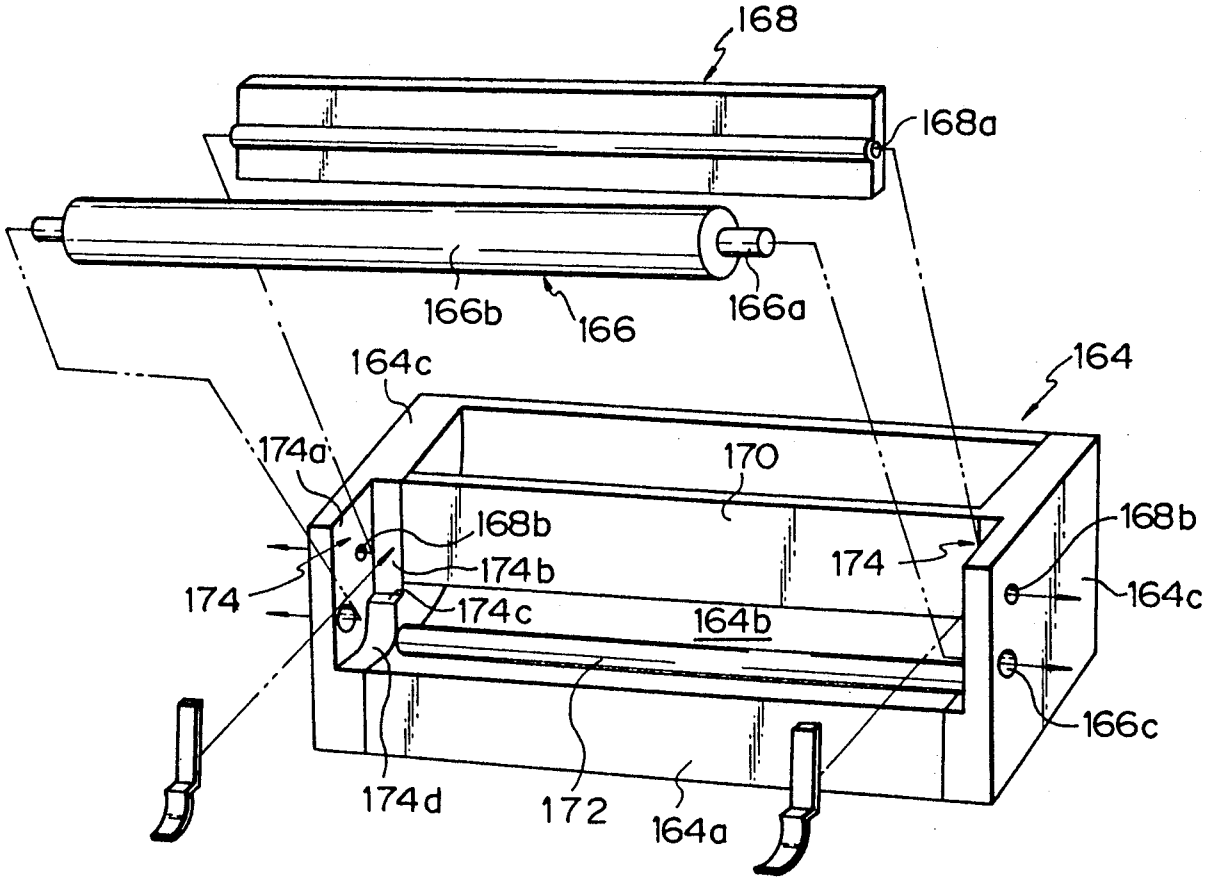
FIG. 28 is an exploded view showing an embodiment of a developing device according to yet another aspect of the present invention.
Figure 29:
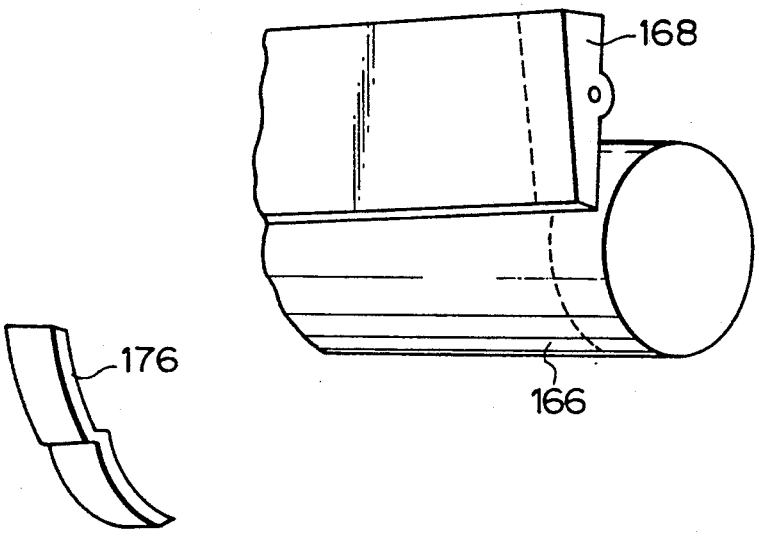
FIG. 29 is an enlarged perspective view showing an end of both a developing roller and a blade member together with a seal member applied thereto.
Figure 30:
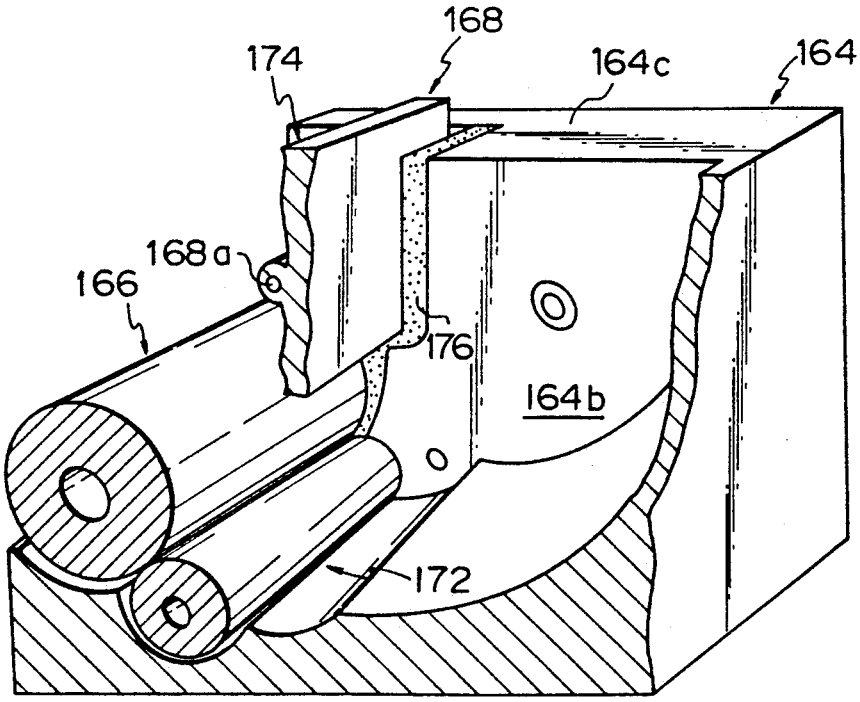
FIG. 30 is a perspective broken view showing a seal arrangement of the developing device FIG. 29.

This developing device comprises a vessel 164 for holding the non-magnetic type one-component developer, which is assembled from a vessel body 164*a* having a recess 164*b*, and a pair of rectangular side wall members 164*c* securely attached to side faces of the vessel body 164*a*. As shown in FIG. 28, the recess or developer storage chamber 164*b* is formed in such a manner that a large opening is formed at a front side of the vessel 164 while a portion of the vessel body 164*a* forms a rear wall of the vessel 164. The developing device also comprises a developing roller 166 having a shaft 166*a* rotatably supported by the side wall members 164*c* at the front side of the vessel 164, and a roller element 166*b* mounted thereon and formed of a conductive elastic material, preferably a conductive open-cell foam elastic material, for the reason stated hereinbefore. Note, in FIG. 28, through holes 166*c* are formed in the side wall member to receive the ends of the developing roller shaft 166*a*. The developing device further comprises a blade member 168 swingably supported between the side wall member 164*c* at a rear of the developing roller 166. Namely, the blade member 168 has a through hole 168*a* formed along the longitudinal axis thereof and registered with holes 168*b* formed in the side wall members 164*c*, and a pivot pin (not shown) is extended from one of the holes 168*b* to the other holes 168*b* through the through hole 168*a*, whereby the blade member 168 is swingable about the longitudinal axis thereof. Furthermore, the developing device comprises a partition 170 securely supported between the side wall members 164*c* at a rear of the blade member 168, and a toner-removing roller 172 rotatably supported between the side wall members 164*c* below the developing roller 166 and engaged therewith. Note, the developing roller 166, the blade member 168, the partition 170, and the toner-removing roller 172 are equivalent to the corresponding elements of FIG. 1.

As shown in FIG. 28, the developing roller 166 and the blade member 168 have axial lengths larger than a width of the recess or developer storage chamber corresponding to an axial length of the partition 170. Accordingly, each of the side wall members 164*c* is formed with a recess 174 at the inner wall surface thereof for receiving the corresponding ends of the developing roller 166 and blade member 168. Each of the recesses 174 is defined by a bottom surface portion 174*a* and first, second, and third side surface portions 174*b*, 174*c*, and 174*d* perpendicularly raised from the bottom surface portion 174*a*. As apparent from FIGS. 29 and 30, a profile defined by the first, second, and third side surface portions 174*b*, 174*c*, and 174*d* substantially conforms with the back profile (defined by a broken line in FIG. 29) of the ends of the developing roller 166 and blade member 168, and the former profile surface is spaced from the latter profile surface to receive a seal member 176 therebetween. The seal member 176 is preferably shaped so as to be received and compressed between the profile surfaces. With this developer seal arrangement, leakage of the developer at locations near the ends of the developer roller 166 can be completely prevented.

Figure 31:
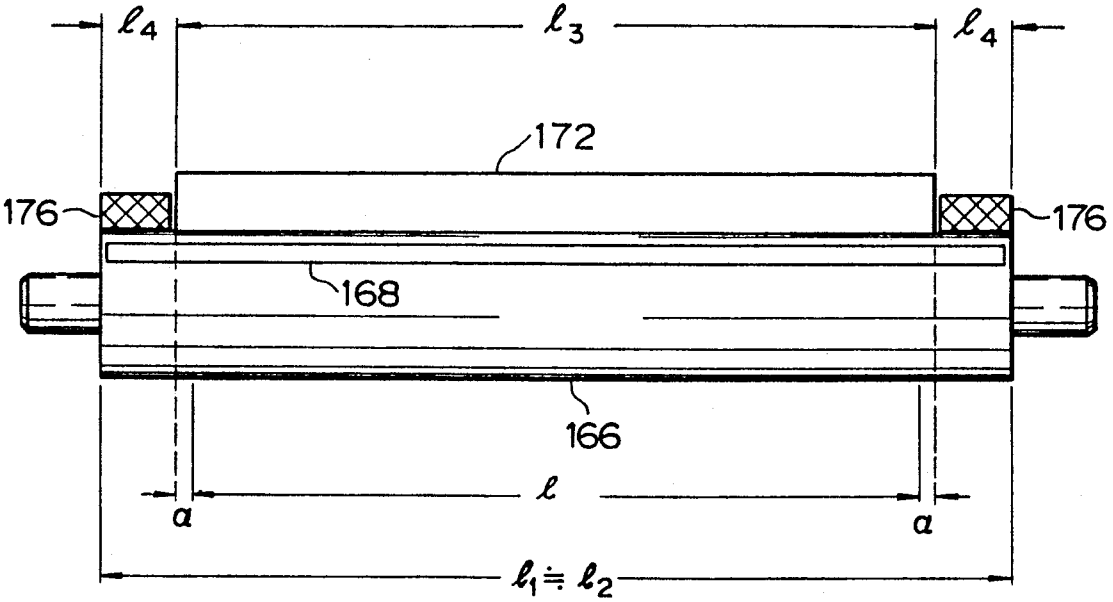
FIG. 31 is a plan view showing the dimensional and positional relationship among the developing roller, the blade member and other elements.

In summary, as shown in FIG. 31, the developer seal arrangement is based upon the fact that axial lengths $l_1$ and $l_2$ of the developing roller 166 and blade member 168 are longer than a width $l_3$ of a developer stream directed from the developer storage chamber 164*b* toward the developing roller 166 during the development, and that the seal members 176 are applied to the end zones of the developing roller 166 and the end zones of the blade member 168 having a width $l_4$ and separated from the developer stream directed to the developing roller 166. The width $l_3$ of the developer stream is usually represented by a width of the developer storage chamber 164*b*, the partition 170 or the toner-removing roller 172. As is easily understood, the width $l_4$ is defined by the following formula:

$$l_4=(l_1 \text{ or } l_2-l_3)/2$$

In FIG. 31, although the length $l_1$ of the developing roller 166 is nearly equal to the width $l_2$ of the blade member 168, they may be different from each other, if necessary. Note, in FIG. 31, $l_5$ indicates an effective developing range which is narrower by $2\alpha$ than the width $l_1$ of the developing roller 166, because sufficient developer cannot be fed to the end zone having the width $\alpha$.

Although the embodiments of the present invention are explained in relation to a photosensitive drum, they can be also applied to a dielectric drum on which the electrostatic latent image can be formed. Further, although the developing device according to the present invention is used for the non-magnetic type one-component developer, the magnetic type one-compnent developer may be also used, if necessary.

Finally, it will be understood by those skilled in the art that the foregoing description is of preferred embodiments of the present invention, and that various changes and modifications can be made thereto without departing from the spirit and scope thereof.

We claim:

1. A developing device using a one-component developer composed of toner particles, comprising:

a vessel for holding the developer, said vessel being movable between first and second positions;

a developing roller rotatably provided within and supported by said vessel so that a portion of said developing roller is exposed therefrom, the exposed portion of said developing roller being pressed against a surface of an electrostatic latent image carrying body when positioning said vessel at the first position thereof, said developing roller being formed of a conductive elastic material by which the toner particles are entrained to form a developer layer around said developing roller and are carried to the surface of said electrostatic latent image carrying body for development of an electrostatic latent image formed thereon;

a blade member means provided within and movably supported by said vessel, said blade member means being movable between first and second positions, said blade member for regulating a thickness of the developer layer formed around said developing roller when positioning said blade member means at the first position thereof pressed against said developing roller; and means for moving said vessel and said blade member means from the first positions thereof to the second positions thereof and for controlling at least partial release of the pressures exerted on said developing roller by said electrostatic latent image carrying body and said blade member means, respectively.

2. A developing device as set forth in claim 1, wherein said moving-means includes an actuator, and a link/lever mechanism for an operative connection between the actuator and both said vessel and said blade member, the link/lever mechanism being arranged so that said vessel and said blade member are positioned at the first positions thereof when the actuator is energized, and that said vessel and said blade member are positioned at the second positions thereof when the actuator is de-energized.

3. A developing device as set forth in claim 2, wherein the actuator is a solenoid actuator.

4. A developing device as set forth in claim 1, wherein said moving-means includes an actuator, and a cam/link mechanism for an operative connection between the actuator and both said vessel and said blade member, the cam/link mechanism being arranged so that said vessel and said blade member are positioned at the first positions thereof when the actuator is energized, and that said vessel and said blade member are positioned at the second positions thereof when the actuator is de-energized.

5. A developing device as set forth in claim 4, wherein the actuator is a rotary magnetic actuator.

6. A developing device using a one-component developer composed of toner particles, comprising:

a vessel for holding the developer, said vessel being movable between first and second positions;

a developing roller rotatably provided within and supported by said vessel so that a portion of said developing roller is exposed therefrom, the exposed portion of said developing roller being pressed against a surface of an electrostatic latent image carrying body when positioning said vessel at the first position thereof, said developing roller being formed of a conductive elastic material by which the toner.

7. A developing device as set forth in claim 6, wherein said vessel moving-means includes a first actuator operatively coupled to said vessel, the first actuator being arranged so that said vessel is positioned at the first position thereof when the first actuator is energized, and that said vessel is positioned at the second position thereof when the first actuator is de-energized, and wherein said blade member moving-means includes a second actuator operatively coupled to said blade member, the second actuator being arranged so that said blade member is positioned at the first position thereof when the second actuator is energized, and that said blade member is positioned at the second position thereof when the second actuator is de-energized.

8. A developing device as set forth in claim 7, wherein each of the first and second actuators is a solenoid actuator.

9. A developing device using a one-component developer composed of toner particles, comprising:

a vessel for holding the developer;

a developing roller rotatably provided within and supported by said vessel so that a portion of said developing roller is exposed therefrom, the exposed portion of said developing roller facing a surface of an electrostatic latent image carrying body which is movable between first and second positions, the electrostatic latent image carrying body being pressed against the exposed portion of said developing roller when positioning said electrostatic latent image carrying body at the first position thereof, said developing roller being formed of a conductive elastic material by which toner particles are entrained to form a developer layer around said developing roller and are carried to the surface of said electrostatic latent image carrying body for development of an electrostatic latent image formed thereon;

a blade member provided within and movably supported by said vessel, said blade member being movable between first and second positions, said blade member being pressed against said developing roller for regulating a thickness of the developer layer formed around said developing roller when positioning said blade member at the first position thereof pressed against said developing roller; and means for moving said electrostatic latent image carrying body and said blade member from the first position thereof to the second positions thereof and for controlling at least partial release of the pressures exerted on said developing roller by said electrostatic latent image carrying body and said blade member, respectively.

10. A developing device as st forth in claim 9, wherein said moving-means includes an actuator, and a cam/lever mechanism for an operative connection between the actuator and both said electrostatic latent image carrying body and said blade member, said cam/lever mechanism being arranged so that said electrostatic latent image carrying body and said blade member are positioned at the first positions thereof when the actuator is energized, and that said electrostatic latent image carrying body and said blade member are positioned at the second positions thereof when the actuator is de-energized.

11. A developing device as set forth in claim 10, wherein the actuator is a rotary magnetic actuator.

12. A developing device using a one-component developer composed of toner particles, comprising:

a vessel for holding the developer;

a developing roller rotatably provided within and supported by said vessel so that a portion of said developing roller is exposed therefrom, the exposed portion of said developing roller facing a surface of an electrostatic latent image carrying body which is movable between first and second positions, said electrostatic latent image carrying body being pressed against the exposed portion of said developing roller when positioning said electrostatic latent image carrying body at the first position thereof, said developing roller being formed of a conductive elastic material by which the toner particles are entrained to form a developer layer around said developing roller and are carried to the surface of said electrostatic latent image carrying body for development of an electrostatic latent image formed thereon;

a blade member provided within and movably supported by said vessel, said blade member being movable between first and second positions, said blade member being pressed against said developing roller for regulating a thickness of the developer layer formed around said developing roller when positioning said blade member at the first position thereof pressed against said developing roller;

means for moving said electrostatic latent image carrying body from the first position thereof to the second position thereof and for controlling at least partial release of the pressure exerted on said developing roller by said electrostatic latent image carrying body; and means for moving said blade member from the first position thereof to the second position thereof and for controlling at least partial release of the pressure exerted on said developing roller by said blade member.

13. A developing device as set forth in claim 12, wherein said electrostatic latent image carrying body moving-means includes a first actuator operatively coupled to said electrostatic latent image carrying body through a lever element, the first actuator being arranged so that said electrostatic latent image carrying body is positioned at the first position thereof when the first actuator is energized, and that said electrostatic latent image carrying body is positioned at the second position thereof when the first actuator is de-energized, and wherein said blade member moving-means includes a second actuator operatively coupled to said blade member, the second actuator being arranged so that said blade member is positioned at the first position thereof when the second actuator is energized, and that said blade member is positioned at the second position thereof when the second actuator is de-energized.

14. A developing device as set forth in claim 13, wherein each of the first and second actuators is a solenoid actuator.

15. A developing device using a one-component developer composed of toner particles, comprising:

a vessel for holding the developer, said vessel being movable between first and second positions;

a developing roller rotatably provided within and supported by said vessel so that a portion of said developing roller is exposed therefrom, the exposed portion of said developing roller being pressed against a surface of an electrostatic latent image carrying body when positioning said vessel at the first position thereof, said developing roller being formed of a conductive elastic material by which the toner particles are entrained to form a developer layer around said developing roller and are carried to the surface of said electrostatic latent image carrying body for development of an electrostatic latent image formed thereon;

a blade member means provided within and movably supported by said vessel, said blade member means being movable between first and second positions, said blade member for regulating a thickness of the developer layer formed around said developing roller when positioning said blade member means at the first position thereof pressed against said developing roller; and means for moving said vessel and said blade member from the first positions thereof to the second positions thereof and for controlling at least partial release of the pressures exerted on said developing roller by said electrostatic latent image carrying body and said blade member means, respectively.

16. A developing device as set forth in claim 15, wherein said moving-means includes an actuator, and a link/lever mechanism for an operative connection between the actuator and both said vessel and said blade member, said link/lever mechanism being arranged so that said vessel and said blade member are positioned at the first positions thereof when the actuator is energized, and that said vessel and said blade member are positioned at the second positions thereof when the actuator is de-energized.

17. A developing device as set forth in claim 16, wherein the actuator is a solenoid actuator.

18. A developing device as set forth in claim 15, wherein said moving-means includes an actuator, and a cam/link mechanism for an operative connection between the actuator and both said vessel and said blade member, said cam/link mechanism being arranged so that said vessel and said blade member are positioned at the first positions thereof when the actuator is energized, and that said vessel and said blade member are positioned at the second positions thereof when the actuator is de-energized.

19. A developing device as set forth in claim 18, wherein the actuator is a rotary magnetic actuator.

20. A developing device using a one-component developer composed of toner particles, comprising:

a vessel for holding the developer, said vessel being movable between first and second positions;

a developing roller rotatably provided within and supported by said vessel so that a portion of said developing roller is exposed therefrom, the exposed portion of said developing roller being pressed against a surface of an electrostatic latent image carrying body when positioning said vessel at the first position thereof, said developing roller being formed of a conductive elastic material by which the toner particles are entrained to form a developer layer around said developing roller and are carried to the surface of said electrostatic latent image carrying body for development of an electrostatic latent image formed thereon; and means for moving said vessel from the first position thereof to the second position thereof and for controlling at least a partial release of the pressure exerted on said developing roller by said electrostatic latent image carrying body.

21. A developing device using a one-component developer composed of toner particles, comprising:

a vessel for holding the developer;

a developing roller rotatably provided within and supported by said vessel so that a portion of said developing roller is exposed therefrom, the exposed portion of said developing roller being pressed against a surface of an electrostatic latent image carrying body, said developing roller being formed of a conductive elastic material by which the toner particles are entrained to form a developer layer around said developing roller and are carried to the surface of said electrostatic latent image carrying body for development of an electrostatic latent image formed thereon;

a blade member means provided within and movably supported by said vessel, said blade member means being movable between first and second positions, said blade member means for regulating a thickness of the developer layer formed around said developing roller when positioning said blade member means at the first position thereof pressed against said developing roller; and means for moving said blade member means from the first position thereof to the second position thereof and for controlling at least a partial release of the pressure exerted on said developing roller by said blade member means.

22. A developing device using a one-component developer composed of toner particles, comprising:

a vessel for holding the developer;

a developing roller rotatably provided within and supported by said vessel so that a portion of said developing roller is exposed therefrom, the exposed portion of said developing roller facing a surface of an electrostatic latent image carrying body which is movable between first and second positions, said electrostatic latent image carrying body being pressed against the exposed portion of said developing roller when positioning said electrostatic latent image carrying body at the first position thereof, said developing roller being formed of a conductive elastic material by which the toner particles are entrained to orem a developer layer around said developing roller and are carried to the surface of said electrostatic latent image carrying body for development of an electrostatic latent image formed thereon; and means for moving said electrostatic latent image carrying body from the first position thereof to the second position thereof and for controlling at least partial release of the pressure exerted on said developing roller by said electrostatic latent image carrying body.

23. A developing device using a one-component developer composed of toner particles, comprising:

a movable vessel for holding the developer;

a developing roller rotatably provided within and supported by said movable vessel in such a manner hat a portion of said developing roller is exposed therefrom, the exposed portion of said developing roller being pressed against a surface of an electrostatic latent image carrying body by biasing said movable vessel toward said electrostatic latent image carrying body, said developing roller being formed of a conductive elastic material by which the toner particles re entrained to form a developer layer around said developing roller and re carried to the surface of said electrostatic latent image carrying body for development of an electrostatic latent image formed thereon; and a drive source for rotating said developing roller, said drive source being attached to said movable vessel.

24. A developing device as set forth in claim 23, wherein said vessel is mounted in a frame which is movable toward and away from the electrostatic latent image carrying body.

25. A developing device as set forth in claim 23, wherein said vessel is swingably suspended from a frame so as to be movable toward and away from the electrostatic latent image carrying body.

26. A developing device using a one-component developer composed of toner particles, comprising:

a vessel for holding the developer, said vessel being mounted in a movable frame;

a developing roller rotatably provided within and supported by said movable vessel so that a portion of said developing roller is exposed therefrom, the exposed portion of said developing roller being pressed against a surface of an electrostatic latent image carrying body by biasing said movable vessel toward said electrostatic latent image carrying body, said developing roller being formed of a conductive elastic material by which the toner particles are entrained to form a developer layer around said developing roller and are carried to the surface of said electrostatic latent image carrying body for development of an electrostatic latent image formed thereon; and a drive source for rotating said developing roller, said drive source being attached to said movable frame.

27. A developing device using a one-component developer composed of toner particles, comprising:

a vessel for holding the developer;

means for carrying the developer from said vessel to an electrostatic latent image carrying body or development of an electrostatic latent image formed thereon;

an agitator having an agitating element rotated within said vessel for agitating the developer; and means for detecting a lack of the developer held in said vessel, said lack of developer detecting means including a first element entrained and rotated by the agitating element, a second element rotated together with the first element, a third element rotated together with the agitating element, and a detector for detecting a passage of the second element to a given position, wherein when the first element is entrained and rotated by the agitating element, the second and third elements are aligned with each other so that a detection of the passage of the second element by the detector is prevented by the third element, and further wherein when an amount of the developer is less than a predetermined level, the first element is rotated faster, due to the force of gravity, than the agitating element so that a detection of the passage of the second element by the detector becomes possible.

28. A developing device as set forth in claim 27, wherein the detector is a photo-sensor for emitting light and for detecting a reflection of the emitted light, the second and third elements having a reflective surface and a non-reflective surface, the photo-sensor being oriented at a given position so that the light emitted therefrom is perpendicular to the reflective surface of the said second element.

29. A developing device using a one-component developer composed of toner particles, comprising:

a vessel for holding the developer;

a developing roller rotatably provided within and supported by said vessel so that a portion of said developing roller is exposed therefrom, the exposed portion of said developing roller facing a surface of an electrostatic latent image carrying body, said developing roller being formed of a conductive elastic material by which toner particles are entrained to form a developer layer around said developing roller and are carried to the surface of said electrostatic latent image carrying body for development of an electrostatic latent image formed thereon; and a blade member provided within and movably supported by said vessel, said blade member being movable between first and second positions, said blade member being pressed against said developing roller for regulating a thickness of the developer layer formed around said developing roller, wherein axial lengths of said developing roller and said blade member are longer than a width of a developer stream directed to said developing roller on said vessel, and wherein seal members are applied to end zones of said developing roller and end zones of said blade member.

* * * * *

US005068691A

REEXAMINATION CERTIFICATE (2457th)

United States Patent [19]

[11] B1 5,068,691

Nishio et al.

[45] Certificate Issued Jan. 24, 1995

[54] DEVELOPING DEVICE WITH A CONTROLLABLE PRESSURE RELEASE FOR THE DEVELOPING ROLLER

[75] Inventors: Yukio Nishio, Tama; Kazunori Hirose, Hiratsuka, both of Japan

[73] Assignee: Fujitsu Limited, Kawasaki, Japan

Reexamination Request:
No. 90/003,111, Jun. 30, 1993

Reexamination Certificate for:

| | |
|---|---|
| Patent No.: | **5,068,691** |
| Issued: | **Nov. 26, 1991** |
| Appl. No.: | **530,518** |
| Filed: | **May 30, 1990** |

[30] Foreign Application Priority Data

| | | | |
|---|---|---|---|
| Jun. 1, 1989 | [JP] | Japan | 1-139445 |
| Jun. 5, 1989 | [JP] | Japan | 1-141217 |
| Jun. 21, 1989 | [JP] | Japan | 1-159320 |
| Jun. 26, 1989 | [JP] | Japan | 1-163120 |

[51] Int. Cl.[6] ..... G03G 15/08

[52] U.S. Cl. ..... 355/259; 118/261; 118/653

[58] Field of Search ..... 355/259, 245; 118/644, 118/653, 261

[56] References Cited

U.S. PATENT DOCUMENTS

| | | | |
|---|---|---|---|
| 3,067,720 | 12/1962 | Lewis | 118/308 |
| 4,674,441 | 6/1987 | Kohyama | 118/707 |

FOREIGN PATENT DOCUMENTS

| | | |
|---|---|---|
| 0269402 | 11/1987 | European Pat. Off. . |
| 0294097 | 5/1988 | European Pat. Off. . |
| 0314436 | 10/1988 | European Pat. Off. . |
| 2176718 | 6/1986 | United Kingdom . |

OTHER PUBLICATIONS

Japanese Patent Abstract, vol. 11, No. 362 (P-640) [2809], Nov. 26, 1987.
Japanese Patent Abstract, vol. 7, No. 78 (P-188) [1223], Mar. 31, 1983.
European Search Report dated Jun. 18, 1991.
Partial European Search Report dated Feb. 4, 1991.
European Search Report dated Mar. 20, 1989.
European Search Report (undated).

*Primary Examiner*—R. L. Moses

[57] ABSTRACT

The present invention is directed to a developing device using a one-component developer composed of colored fine sythetic resin toner particles. The device includes a vessel for holding the developer and a developing roller rotatably provided within the vessel, a portion thereof being exposed therefrom and resiliently pressed against a surface of an photosensitive drum. The toner particles are held by the surface of the developing roller to form a developer layer therearound, and are carried to the surface of the image formation drum for development of an electrostatic latent image formed thereon. The developing device further incorporates a blade member provided within the vessel and resiliently engaged with the developing roller for regulating a thickness of the developer layer formed therearound. The pressures exerted on the developing roller by the photosensitive drum and the blade member, respectively, can be at least partially released.

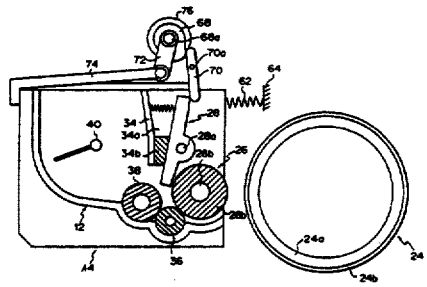

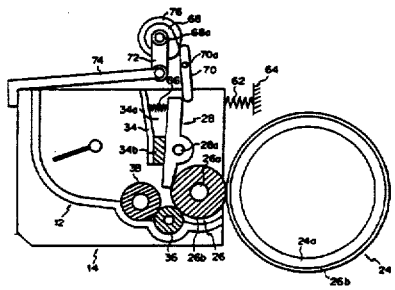

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–5, 9–19, 21, 22, 26–28 is confirmed.

Claims 20, 29 are cancelled.

Claims 6, 23 are determined to be patentable as amended.

Claims 7, 8 and 24, 25, dependent on an amended claim, are determined to be patentable.

New claims 30–33 are added and determined to be patentable.

6. A developing device using a one-component developer composed of toner particles, comprising:

a vessel for holding the developer, said vessel being moveable between first and second positions;

a developing roller rotatably provided within and supported by said vessel so that a portion of said developing roller is exposed therefrom, the exposed portion of said developing roller being pressed against a surface of an electrostatic latent image carrying body when positioning said vessel at the first position thereof, said developing roller being formed of a conductive elastic material by which the toner *particles are entrained to form a developer layer said developer roller and are carried to the surface of said electrostatic latent image carrying body for development of an electrostatic latent image formed thereon;*

*a blade member means provided within and moveable supported by said vessel, said blade member means being moveable between first and second positions, said blade member for developing a thickness of the developer layer formed around said developing roller when positioning said blade member means at the first position thereof pressed against said developing roller;*

*means for moving said vessel from the first position thereof to the second position thereof and for controlling at least partial release of the pressures exerted on said developing roller by said electrostatic latent image carrying body; and*

*means for moving said blade member means from the first position thereof to the second position thereof and for controlling at least partial release of the pressures exerted on said developing roller by said blade member means.*

23. A developing device using a one-component developer composed of toner particles, comprising:

a vessel for holding the developer;

a developing roller rotatably provided within and supported by said movable vessel [in such a manner hat] *such that* a portion of said developing roller is exposed therefrom, the exposed portion of said developing roller being pressed against a surface of an electrostatic latent image carrying body by biasing said movable vessel toward said electrostatic latent image carrying body, said developing roller being formed of a conductive elastic material by which the toner particles [re] *are* entrained to form a developer layer around said developing roller and [re] *are* carried to the surface of said electrostatic latent image carrying body for development of an electrostatic latent image formed thereon; and a drive source for rotating said developing roller, said drive source being attached to said movable vessel.

*30. A developing device as set forth in claim 23, wherein said drive source is completely attached to said movable vessel.*

*31. A developing device as set forth in claim 30, wherein said drive source comprises an electric motor attached to said movable vessel.*

*32. A developing device as set forth in claim 26, wherein said drive source is completely attached to said movable frame.*

*33. A developing device as set forth in claim 32, wherein said drive source comprises an electric motor attached to said movable frame.*

* * * * *